US007598834B2

(12) United States Patent
Whitaker et al.

(10) Patent No.: US 7,598,834 B2
(45) Date of Patent: Oct. 6, 2009

(54) ELECTRICAL SWITCHING APPARATUS AND ACCESSORY TRAY THEREFOR

(75) Inventors: Thomas A. Whitaker, N. Huntingdon, PA (US); Erik R. Bogdon, Carnegie, PA (US); Ronald W. Brand, Beaver Falls, PA (US); Robert S. Estok, Moon Township, PA (US); James M. Smeltzer, Salem, OH (US)

(73) Assignee: Eaton Corporation, Cleveland, OH (US)

( * ) Notice: Subject to any disclaimer, the term of this patent is extended or adjusted under 35 U.S.C. 154(b) by 113 days.

(21) Appl. No.: 11/692,500

(22) Filed: Mar. 28, 2007

(65) Prior Publication Data

US 2008/0237192 A1 Oct. 2, 2008

(51) Int. Cl.
*H01H 67/02* (2006.01)
*H01H 9/02* (2006.01)
*H01H 13/04* (2006.01)

(52) U.S. Cl. ..... 335/202; 335/132

(58) Field of Classification Search ..... 335/132, 335/202; 200/293–308
See application file for complete search history.

(56) References Cited

U.S. PATENT DOCUMENTS 3,354,415 A * 11/1967 Gribble et al. ..... 335/131
4,166,260 A * 8/1979 Gillette ..... 335/20
4,254,316 A * 3/1981 Landow ..... 200/308
4,297,663 A * 10/1981 Seymour et al. ..... 335/20
4,345,225 A * 8/1982 Lemmer ..... 335/132
4,872,087 A 10/1989 Brant
5,075,658 A * 12/1991 Lesslie et al. ..... 335/14
5,107,236 A * 4/1992 Lesslie et al. ..... 335/132
5,230,422 A * 7/1993 Karweik et al. ..... 200/307
5,258,732 A * 11/1993 Marquardt ..... 335/17
5,362,933 A * 11/1994 Kutsche et al. ..... 200/401
5,652,420 A * 7/1997 Innes et al. ..... 200/50.32
5,870,277 A * 2/1999 Girard et al. ..... 361/627
6,166,616 A * 12/2000 Fischer et al. ..... 335/172

(Continued)

FOREIGN PATENT DOCUMENTS

FR 2759489 A 8/1998

OTHER PUBLICATIONS

European Search Report issued in European Application No. EP 08 00 5863.

*Primary Examiner*—Elvin G Enad
*Assistant Examiner*—Alexander Talpalatskiy
(74) *Attorney, Agent, or Firm*—Martin J. Moran

(57) ABSTRACT

An accessory tray is provided for an electrical switching apparatus, such as a circuit breaker, including a housing, an operating mechanism, and a number of accessories. The housing has a cavity with a first end and the second end, and is disposed beneath the operating mechanism. The accessory tray includes an elongated member including first and second ends and is structured to receive the circuit breaker accessories. A guide mechanism guides the elongated member into and out of the cavity, in order to install the circuit breaker accessories beneath the operating mechanism. When the elongated member is disposed within the cavity, the first end is disposed at or about the cavity first end and the second end is disposed at or about the cavity second end. The accessory tray may be a single-piece molded member having a plurality of mounting portions for removably securing a plurality of circuit breaker accessories.

16 Claims, 13 Drawing Sheets

U.S. PATENT DOCUMENTS 6,172,584 B1 * 1/2001 Castonguay et al. ..... 335/172
6,232,855 B1 5/2001 Malingowski et al.
6,255,926 B1 7/2001 Gundy et al.
6,297,718 B1 * 10/2001 Scholz et al. ..... 335/202
6,600,396 B1 * 7/2003 Rodriguez et al. ..... 335/132
6,677,841 B2 * 1/2004 Passow ..... 335/132
6,707,357 B1 * 3/2004 Chuang ..... 335/132
6,784,770 B2 * 8/2004 Gimenez et al. ..... 335/18
6,867,671 B2 * 3/2005 Rodriguez et al. ..... 335/132
6,897,748 B2 * 5/2005 Yamagata et al. ..... 335/132
6,936,781 B2 * 8/2005 Quintanilla et al. ..... 200/304
6,943,652 B2 * 9/2005 Rodriguez et al. ..... 335/6
7,023,303 B1 4/2006 Bogdon et al.
7,474,182 B2 * 1/2009 Bolz et al. ..... 335/131
2002/0060619 A1 * 5/2002 Mani et al. ..... 335/132
2003/0090352 A1 * 5/2003 Lee et al. ..... 335/202
2004/0066260 A1 * 4/2004 Rodriguez et al. ..... 335/172
2006/0066427 A1 * 3/2006 Miller ..... 335/132
2006/0071740 A1 4/2006 Bogdon et al.
2006/0071744 A1 4/2006 Bogdon et al.

* cited by examiner

ELECTRICAL SWITCHING APPARATUS AND ACCESSORY TRAY THEREFOR

CROSS-REFERENCE TO RELATED APPLICATIONS

This application is related to commonly assigned, concurrently filed:

U.S. patent application Ser. No. 11,692,488, filed Mar. 28, 2007, entitled "ELECTRICAL SWITCHING APPARATUS AND ACCESSORY ASSEMBLY THEREFOR";

U.S. patent application Ser. No. 11/692,496, filed Mar. 28, 2007, entitled "ELECTRICAL SWITCHING APPARATUS, AND ACCESSORY MODULE AND STRAIN RELIEF MECHANISM THEREFOR";

U.S. patent application Ser. No. 11/692,512, filed Mar. 28, 2007, entitled "ELECTRICAL SWITCHING APPARATUS, AND ACCESSORY MODULE AND ELECTRICAL CONDUCTOR MOUNT THEREFOR";

U.S. patent application Ser. No. 11/692,517, filed Mar. 28, 2007, entitled "ELECTRICAL SWITCHING APPARATUS, AND SUB-ASSEMBLY AND AUXILIARY SWITCH TRAY THEREFOR"; and U.S. patent application Ser. No. 11/692,521, filed Mar. 28, 2007, entitled "ELECTRICAL SWITCHING APPARATUS AND TRIP BAR THEREFOR", which are hereby incorporated herein by reference.

BACKGROUND OF THE INVENTION

1. Field of the Invention

The invention relates generally to electrical switching apparatus and, more particularly, to accessory trays for electrical switching apparatus, such as circuit breakers.

2. Background Information

Electrical switching apparatus, such as circuit breakers, as well as transfer switches, network protectors and the like, are often equipped with accessories such as, for example and without limitation, auxiliary switches, shunt trip devices, under voltage release devices, and bell alarms. Such devices can be employed in a variety of ways to provide signals indicating certain conditions within the apparatus and/or to initiate a change in status of the apparatus such as, for example, to trip open the separable contacts of the apparatus in response to an electrical fault condition (e.g., without limitation, current overload; short circuit; abnormal voltage).

In view of the increasing market trend to reduce the overall size of the circuit breaker, the space which is available within the circuit breaker housing is limited. In addition to size constraints, the location available for mounting accessories within the circuit breaker can also be problematic. For example, some locations for mounting the accessories in the circuit breaker have limited access for installing the accessories and, in some instances, blind installation is required, wherein it is not possible to see the accessory to mount the accessory within the circuit breaker housing. As a result, incorrect installation and/or damage to the accessories can result, and safety features of the circuit breaker can be adversely affected.

It is, therefore, desirable to be able to relatively quickly, easily and accurately install circuit breaker accessories in locations within the circuit breaker that are difficult to reach. It is also desirable to be able to relatively quickly and easily change (e.g., add; remove; exchange; replace) the type, quantity and/or configuration of the accessories employed by the circuit breaker.

There is, therefore, room for improvement in electrical switching apparatus, such as circuit breakers, and in apparatus for installing accessories therein.

SUMMARY OF THE INVENTION

These needs and others are met by embodiments of the invention, which are directed to an accessory tray for electrical switching apparatus, such as circuit breakers, which enables circuit breaker accessories to be relatively quickly, easily and accurately removably installed within the circuit breaker.

As one aspect of the invention, an accessory tray is provided for an 30 electrical switching apparatus including a housing and a number of accessories. The housing has an exterior, a cavity, and at least one protrusion. The accessory tray comprises: a mounting member comprising a first side structured to receive and removably secure the number of accessories of the electrical switching apparatus, and a second side disposed opposite the first side; and a guide mechanism structured to guide the mounting member into the cavity. The mounting member is structured to be removable from the cavity in order to removably secure the number of accessories of the electrical switching apparatus thereon, and the mounting member is structured to be insertable into the cavity to install the number of accessories of the electrical switching apparatus in a predetermined position within the cavity.

The guide mechanism may comprise a number of guides disposed at or about the second side of the mounting member, wherein each of the guides is structured to engage a corresponding one of the at least one protrusion of the housing of the electrical switching apparatus in order to align the mounting member with the cavity. The mounting member may further comprise a first edge and a second edge. The at least one protrusion of the housing may be a first protrusion and a second protrusion, and the number of guides may be a first notch disposed on the second side of the mounting member and extending between the first edge and the second edge, and a second notch disposed on the second side of the mounting member and extending between the first edge and the second edge. When the mounting member is inserted into the cavity, the first notch may be structured to slidably engage the first protrusion and the second notch is structured to slidably engage the second protrusion.

The mounting member may further comprise a first end, a second end disposed opposite and distal from the first end, a generally planar intermediate portion extending from at or about the second end toward the first end, and at least one mounting portion. The at least one mounting portion may comprise a first connection mechanism disposed on the generally planar intermediate portion and a second connection mechanism disposed proximate the second end, wherein the first connection mechanism is structured to receive and secure one end of a corresponding one of the number of accessories, and wherein the second connection mechanism is structured to releasably secure the other end of the corresponding one of the number of accessories. The first connection mechanism may be a molded receptacle extending outwardly from the generally planar intermediate portion of the mounting member. The second connection mechanism may be a resilient tab extending outwardly from the mounting member proximate the second end of the mounting member.

The at least one mounting portion may be a first mounting portion and a second mounting portion. The first mounting portion may extend longitudinally from the second end of the mounting member toward the first end of the mounting member, and the second mounting portion may be disposed at or about the first end of the mounting member and may extend perpendicularly with respect to the first mounting portion. The second mounting portion may comprise at least one molded compartment structured to receive another corresponding one of the number of accessories, wherein the at least one molded compartment comprises a resilient protrusion extending outwardly from the mounting member. The resilient protrusion may be structured to bias against another corresponding one of the number of accessories in order to maintain such one of the number of accessories in a predetermined position with respect to the mounting member.

The mounting member may be a single piece molded member, wherein the at least one mounting portion, the guide member, the first connection mechanism, and the second connection mechanism are molded segments of the single piece member.

As another aspect of the invention, an electrical switching apparatus comprises: a housing including an exterior and a cavity; separable contacts enclosed by the housing; an operating mechanism structured to open and close the separable contacts; a number of accessories being cooperable with the operating mechanism; and an accessory tray comprising: a mounting member comprising a first side and a second side disposed opposite the first side, the number of accessories being receivable on the first side of the mounting member, and a guide mechanism structured to guide the mounting member into the cavity. The mounting member is removable from the cavity in order removably secure the number of accessories thereon, and the mounting member is insertable into the cavity in order to install the number of accessories in a predetermined position within the cavity.

The electrical switching apparatus may be a circuit breaker. The primary accessories may be two accessory modules selected from the group consisting of a shunt trip module and an undervoltage release module, and the two accessory modules may be installed adjacent one another on the first mounting portion of the mounting member of the accessory tray. The number of secondary accessories may be at least one secondary accessory selected from the group consisting of an auxiliary switch and an alarm device, and such secondary accessory may be installed on the second mounting portion of the mounting member of the accessory tray perpendicular with respect to the two accessory modules.

The cavity of the electrical switching apparatus may be disposed beneath the operating mechanism of the electrical switching apparatus, and the accessory tray may be receivable within the cavity in order to install the number of accessories in the predetermined position beneath the operating mechanism. The operating mechanism may include a trip mechanism structured to trip one the separable contacts in response to a trip condition, wherein the accessory tray is receivable beneath the tip mechanism.

As another aspect of the invention, an accessory tray is provided for an electrical switching apparatus including a housing, an operating mechanism, and a number of accessories. The housing has a first end, a second end, and a cavity substantially extending between the first end and the second end, the cavity being disposed beneath the operating mechanism. The accessory tray comprises: an elongated member including a first end and second end disposed opposite and distal from the first end of the elongated member, the elongated member being structured to receive the number of accessories of the electrical switching apparatus; and a guide mechanism structured to guide the elongated member into and out of the cavity, in order to install the number of the accessories of the electrical switching apparatus beneath the operating mechanism. When the elongated member is disposed within the cavity, the first end of the elongated member is structured to be disposed at or about the first end of the cavity and the second end of the elongated member is structured to be disposed at or about the second end of the cavity.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
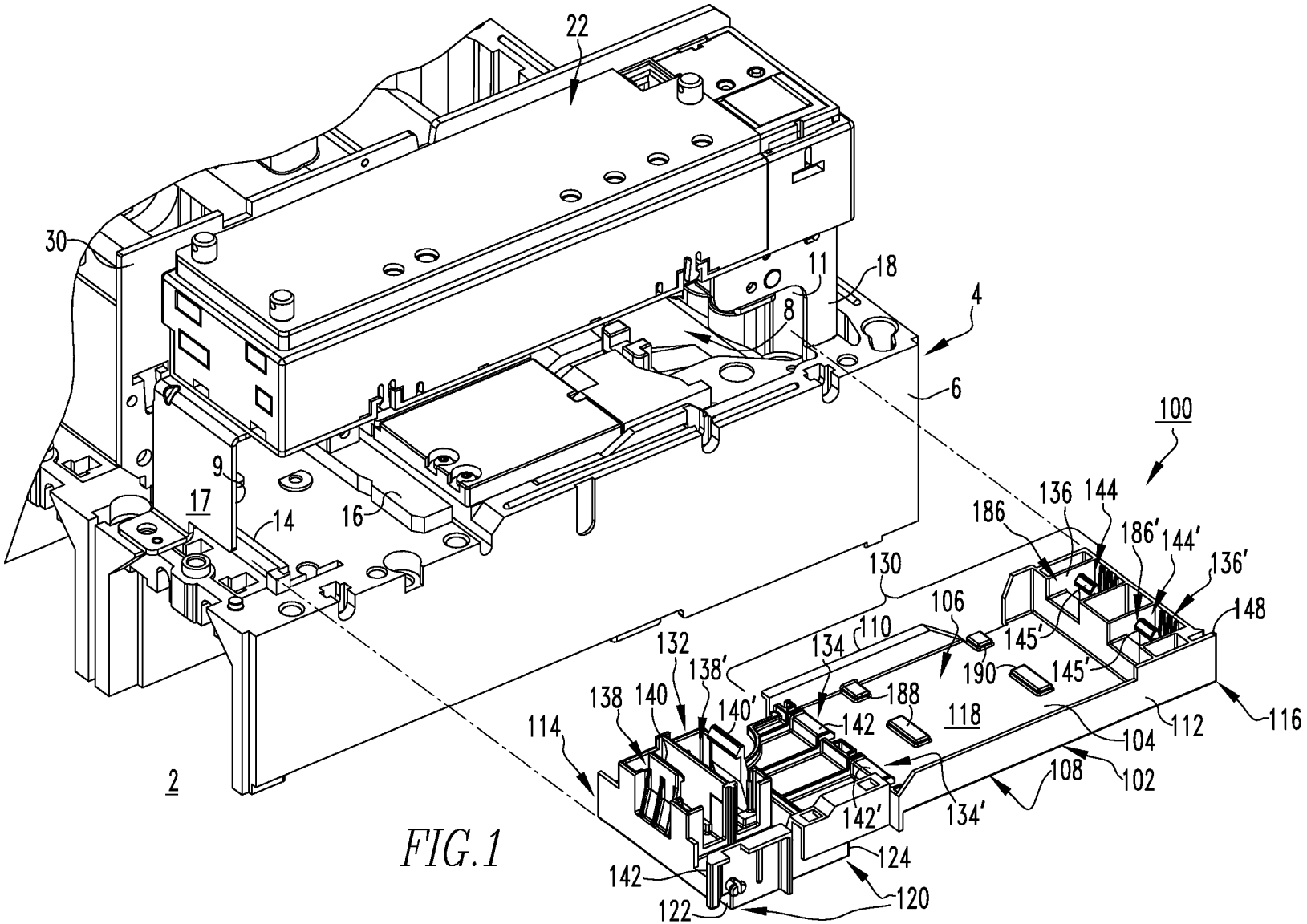
FIG. 1 is an exploded isometric view of a portion of a circuit breaker and an accessory tray therefor, in accordance with an embodiment of the invention.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, left, right, top, bottom, upper, lower, front, back and derivatives thereof, relate to the orientation of the elements shown in the drawings and are not limiting upon the claims unless expressly recited therein.

As employed herein, the terms "actuator" and "actuating mechanism" refer to any known or suitable input or output mechanism for an electrical switching apparatus (e.g., without limitation, circuit switching devices and other circuit interrupters, such as contactors, motor starters, motor controllers and other load controllers) or accessory (e.g., without limitation, auxiliary switch; shunt trip device; under voltage release device; bell alarm) therefore, and expressly include, but are not limited to, stems, plungers, levers, buttons, switches, trip bars, paddles, and arms.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
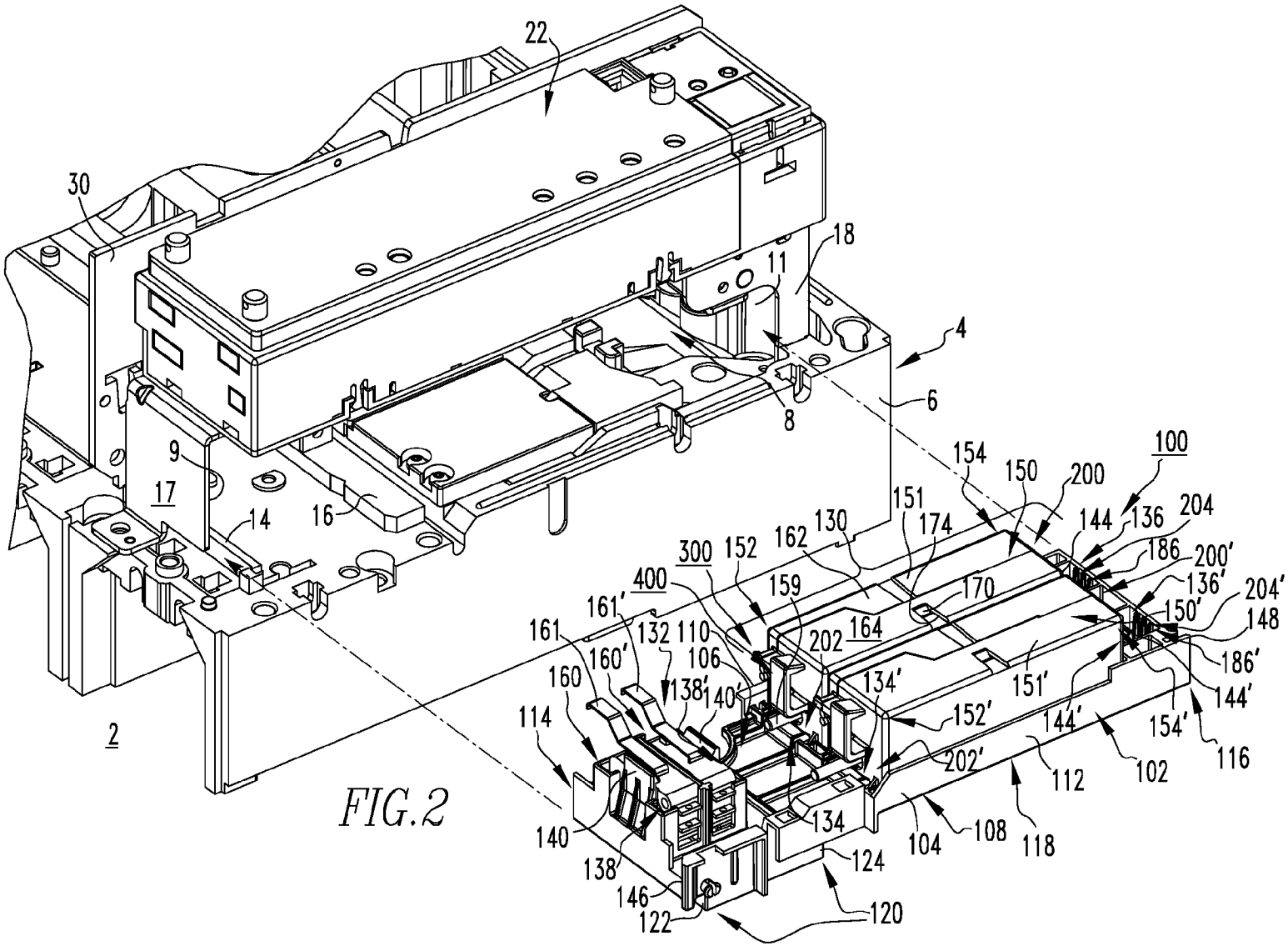
FIG. 2 is an exploded isometric view of the portion of the circuit breaker and accessory tray therefor of FIG. 1, modified to show circuit breaker accessories mounted on the accessory tray.
Figure 3:
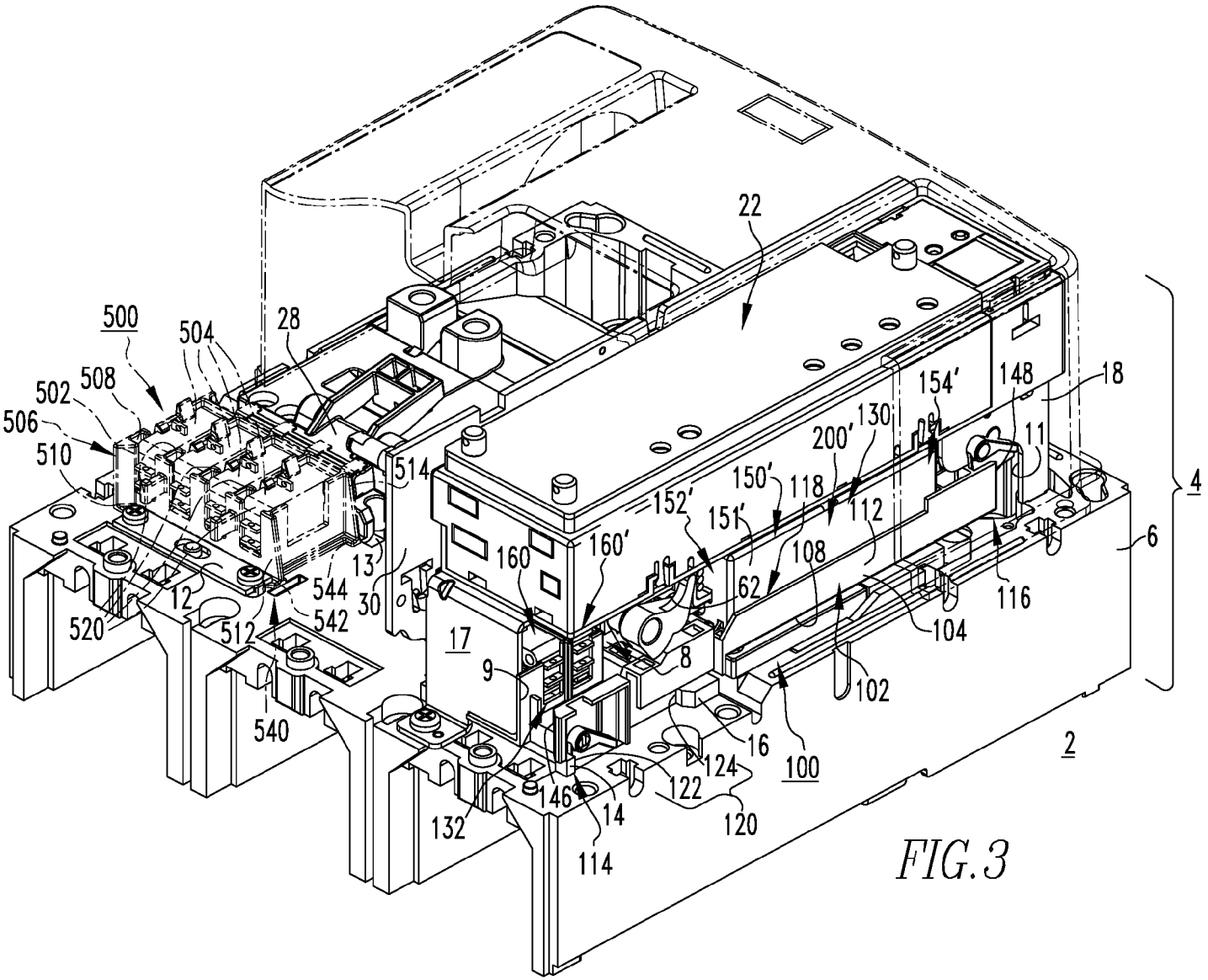
FIG. 3 is an isometric view of the circuit breaker and accessory tray therefor of FIG. 2, showing the accessory tray in the installed position within the circuit breaker.
Figure 9:
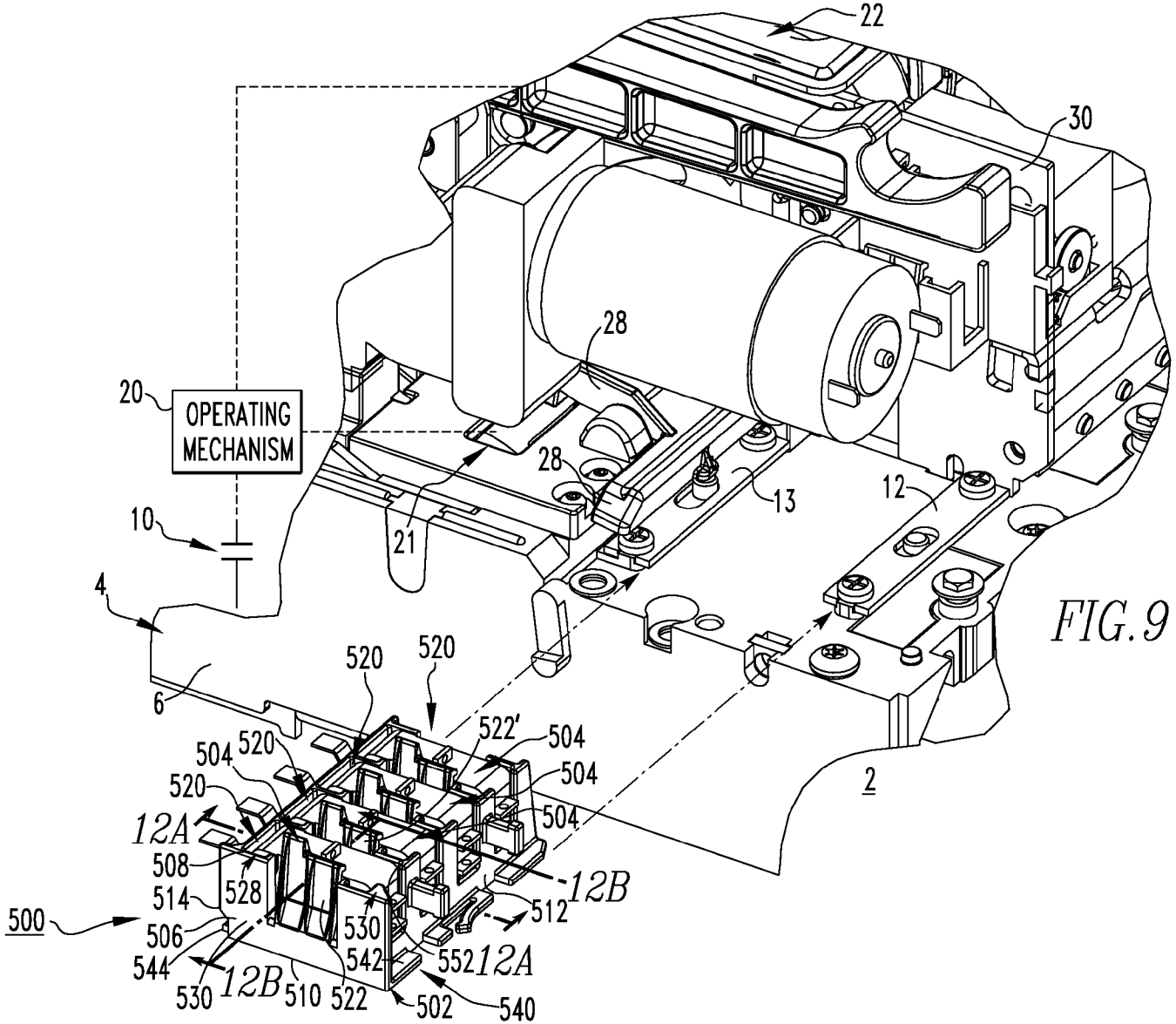
FIG. 9 is an exploded isometric view of a portion of the circuit breaker of FIG. 1 and an auxiliary switch module therefor.

FIGS. 1-3 show an electrical switching apparatus, such as a low-voltage circuit breaker 2, employing an accessory assembly 100 having an accessory tray 102. The circuit breaker 2, which is partially shown, includes a housing 4 (partially shown in phantom line drawing in FIG. 3), separable contacts 10 (shown in simplified form in FIG. 9) enclosed by the housing 4, and an operating mechanism 20 (shown in simplified form in FIGS. 7 and 9) structured to open and close the separable contacts 10 (FIG. 9).

The accessory assembly 100 is mountable within the housing 4, as shown in FIG. 3, and includes at least one accessory, such as the first and second primary accessories 150,150' (e.g., without limitation, shunt trip devices; undervoltage release devices) and the first and second secondary accessories 160,160' (e.g., without limitation, auxiliary switches; alarm devices), shown in FIG. 2. However, as will be discussed hereinbelow, it will be appreciated that any known or suitable type, number and configuration of accessories may be mounted on the accessory tray 102 of the accessory assembly 100, in any suitable combination other than that which is shown and described herein, without departing from the scope of the invention.

Figure 4:
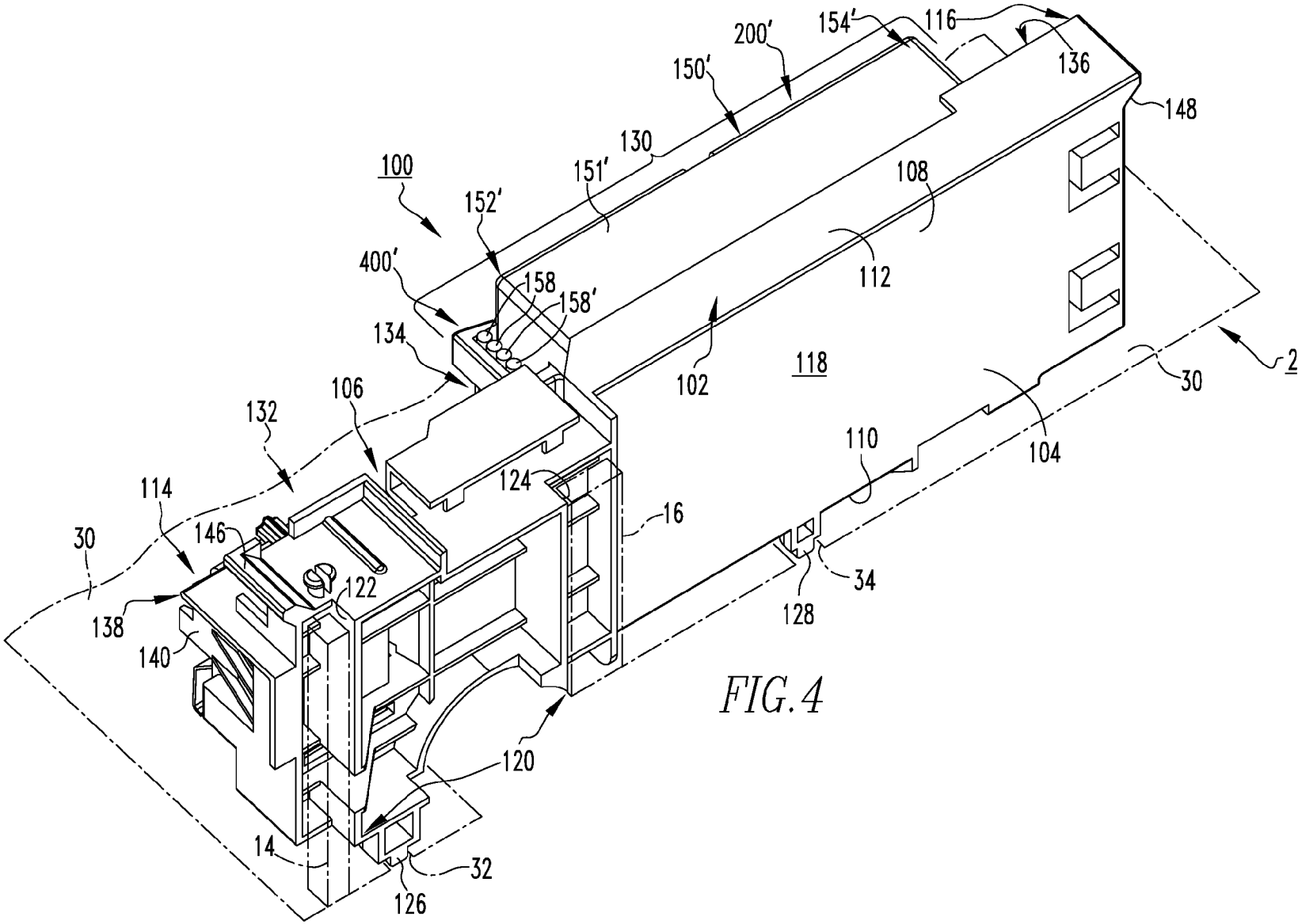
FIG. 4 is an isometric view of the underside of the accessory tray of FIG. 2.

The example accessory tray 102 includes a mounting member 104 having a first side 106 (FIGS. 1 and 2) structured to receive and removably secure the accessories 150,150', 160,160' (all shown in FIG. 2), and a second side 108 disposed opposite the first side 106 (FIGS. 1 and 2). A guide mechanism 120, which is disposed on the second side 108 of the mounting member 104, is structured to guide the mounting member 104 into a cavity 8 of the circuit breaker housing 4. Specifically, the circuit breaker housing 4 has an exterior 6 and at least one protrusion which, in the example shown and described herein is a first guide rail 14 and a second guide rail 16. The guide mechanism 120 is a number of guides which, in the example shown and described herein is a pair of first and second notches 122,124, in the second side 108 of the mounting member 104. When the mounting member 104 is inserted into the cavity 8 of the circuit breaker 2, as shown in FIG. 3, the first notch 122 slidably engages the first guide rail 14 and the second notch 124 slidably engages the second guide rail 16. The guide mechanism 120 and, in particular, the interaction between the first and second guide rails 14 and 16 and the first and second notches 122 and 124, respectively, can be further appreciated with reference to FIG. 4, which illustrates the first and second guide rails 14,16 of the circuit breaker housing 4 (FIGS. 1-3) in simplified form in phantom line drawing. As shown in FIG. 4, the first and second notches 122,124 of the mounting member 104 extend between the first and second edges 110,112 of the mounting member 104. In this manner, the guide mechanism 120 functions to align the mounting member 104 with the cavity 8 (FIGS. 1-3), thereby enabling the accessories 150,150', 160,160' (all shown in FIG. 2) to be installed (FIG. 3) in a predetermined position within the cavity 8 (FIGS. 1-3).

As shown in FIGS. 1-3, the example circuit breaker operating mechanism 20 (shown in simplified form in FIGS. 7 and 9) includes a trip mechanism 22, and the cavity 8 is disposed beneath the trip mechanism 22. Such a location can make it difficult to see and/or access the interior of the cavity 8 in order to install (FIG. 3) the accessories 150,150', 160,160' (all shown in FIG. 2) therein. The disclosed accessory assembly 100, and accessory tray 102 and guide mechanism 120 therefor address and overcome this problem by slidably guiding the elongated member 104 of the accessory tray 102 into and out of the predetermined position within the cavity 8, in order to accurately install the accessories 150,150', 160,160' (FIG. 2) therein, as previously discussed.

Referring again to FIG. 4, the example accessory tray 102 further includes a number of lateral protrusions 126,128 extending laterally outwardly from the first edge 110 of the mounting member 104. These lateral protrusions 126,128 further facilitate the accurate installation of the accessories 150,150',160,160' (only primary accessory 150' is shown in FIG. 4) by engaging corresponding openings 32,34 of a side plate 30 (partially shown in phantom line drawing in FIG. 4) of the circuit breaker 2. Specifically, the side plate 30 includes a first opening 32 and a second opening 34. When the accessory tray 102 is installed within the circuit breaker cavity 8, as shown in FIG. 3, the first lateral protrusion 126 engages the first opening 32 of side plate 30, and the second lateral protrusion 128 engages the second opening 34 of the side plate 30, as shown in simplified form in FIG. 4.

Figures 5A, 5B:
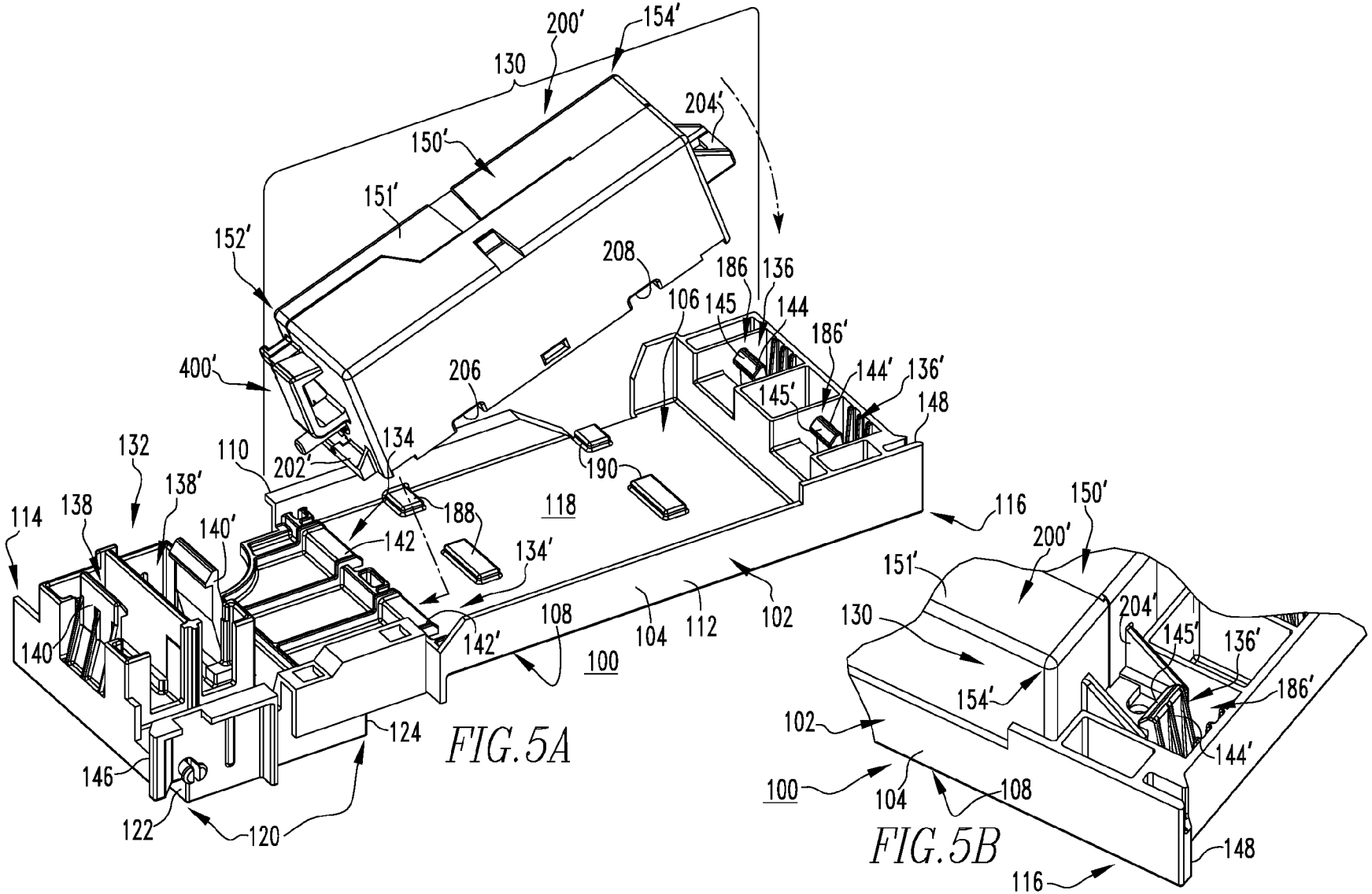
FIG. 5A is an exploded isometric view of the accessory tray of FIG. 1, also showing an accessory module being installed thereon.
FIG. 5B is an isometric view of a portion of the accessory tray of FIG. 5A showing the accessory module after being installed on the accessory tray.
Figure 6:
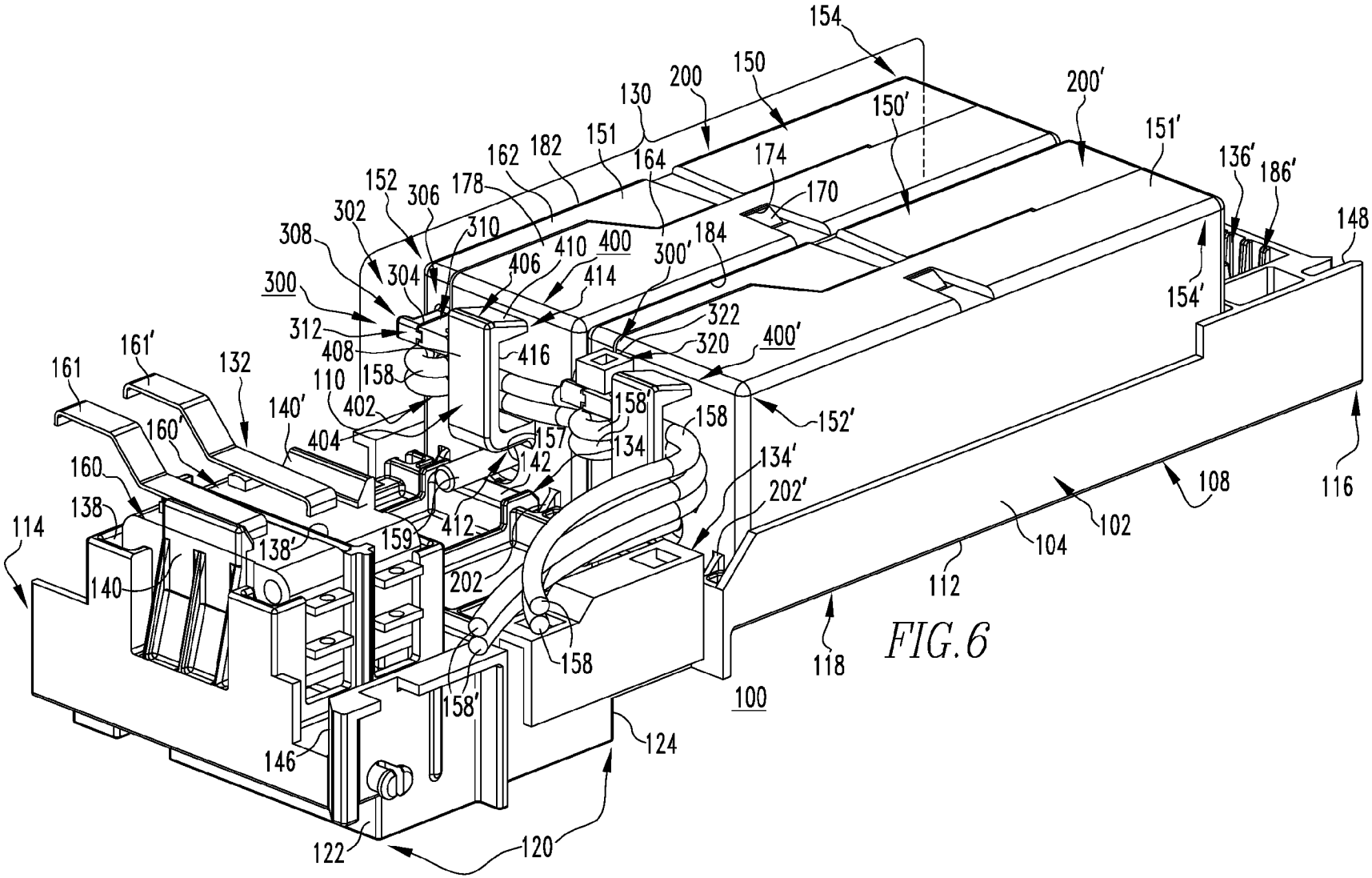
FIG. 6 is an isometric view of the accessory tray of FIG. 2, modified to also show the electrical conductors of the accessory modules and electrical conductor mounts therefor.

Continuing to refer to FIGS. 1-4, and also to FIGS. 5A and 6, it will be appreciated that the mounting member 104 further includes a first end 114, a second end 116 disposed opposite and distal from the first end 114, a generally planar portion 118 extending from at or about the second end 116 toward the first end 114, and at least one mounting portion 130,132. As will be discussed hereinbelow, the example mounting member 104 includes a first mounting portion 130 and a second mounting portion 132, which are respectively structured to receive and secure the aforementioned primary accessories 150,150' and secondary accessories 160,160', preferably without requiring the use of a number of separate fasteners. It will also be appreciated that the example accessories 150, 150',160,160' (all shown in FIG. 2) are preferably removable from their corresponding mounting portions 130,132, without requiring use of a number of separate tools.

The first mounting portion 130 will now be described with reference to FIG. 5A, which shows an accessory module 200' being removably mounted on the mounting member 104 of the accessory tray 102. For economy of disclosure, the first mounting portion 130 will only be described with respect to removably securing mounting module 200', although it will be appreciated that the other accessory module 200 (FIGS. 2, 6 and 7) is mounted to the mounting member 104 in a substantially identical manner. Specifically, the first mounting portion 130 includes a first connection mechanism 134' (see also first connection mechanism 134) disposed on the generally planar intermediate portion 118 of the mounting member 104, and a second connection mechanism 136' (see also second connection mechanism 136) disposed proximate the second end 116 of the mounting member 104. Thus, the first mounting portion 130 of the example accessory tray 102 extends longitudinally from the second end 116 of the mounting member 104 toward the first end 114 thereof. The first connection mechanism 134 is structured to receive and secure one end 152' of the enclosure 151' of a corresponding one of the primary accessories 150', and the second connection mechanism 136 is structured to releasably secure the other end 154' of the accessory 150' (best shown in FIG. 5B). The second mounting portion 132, which will be discussed in greater detail hereinbelow, is disposed at or about the first end 114 of the mounting member 104, and extends perpendicularly with respect to the first mounting portion 130.

The example first connection mechanism 134' is a molded receptacle 142' (see also molded receptacle 142) extending outwardly from the generally planar intermediate portion 118 of the mounting member 104. The example second connection mechanism 136' is a resilient tab 144' (see also resilient tab 144) extending outwardly from the mounting member 104 proximate the second end 116 thereof. The first end 152' of the enclosure 151' of the accessory module 200' includes a first protrusion 202' (see also protrusion 202 of the first end 152 of the enclosure 151 of accessory module 200 of FIGS. 2, 6 and 7) extending outwardly therefrom, and the second end 154' of the enclosure 151 ' includes a second protrusion 204' (see also second protrusion 204 of the second end 154 of the enclosure 151 of accessory module 200 of FIG. 2) extending outwardly therefrom. These protrusions 202', 204' enable the example accessory module 200' to be is installed in a "toe-heel" fashion, in which the first protrusion 202' is first inserted into the molded receptacle 142' and is then rotated (e.g., clockwise with respect to FIG. 5A), as shown, until the second protrusion 204' is releasably secured by the resilient tab 144', as shown in FIG. 5B. In other words, the resilient tab 144' is movable between a first position (FIG. 5A) corresponding to the accessory module 200' not being on the mounting member 104, and a second position (FIG. 5B) corresponding to the accessory module 200' being installed on the mounting member 104. When the accessory module 200' is installed on the mounting member 104, the resilient tab 144' is biased against the second protrusion 204', thereby securing the accessory module 200' on the mounting member 104. If it is subsequently desired to remove the accessory module 200', the resilient tab 144' can simply be deflected (e.g., to the right with respect to FIG. 5B) to release the second protrusion 204'. As previously discussed, this operation can be performed without requiring the use of a number of separate tools (e.g., it can performed by hand).

As shown in FIGS. 5A and 5B, the example resilient tab 144' includes a retention portion 145' (see also retention portion 145 of resilient tab 144 of FIG. 5A). When the accessory module 200' is installed on the mounting member 104, the retention portion 145' overlays the second protrusion 204', as shown in FIG. 5B, in order to further resist the accessory module 200' from being undesirably removed. The example mounting member 104 further includes at least one molded cavity 186' (see also molded cavity 186 of FIG. 5A), which is disposed at or about the second 116 thereof. The resilient tab 144' is disposed within the molded cavity 186' and, when the accessory module 200' is installed on the mounting member 104, as shown in FIG. 5B, the second protrusion 204' of the second end 154' of the enclosure 151' of the accessory module 200' extends into the molded cavity 186' and is secured therein by the resilient tab 144'.

The generally planar intermediate portion 118 of the mounting member 104 of the example accessory tray 102 further includes a number of locating protrusions 188,190, and the accessory modules (e.g., accessory module 200' of FIG. 5A) include a number of corresponding recesses 206, 208. Thus, when the accessory module 200' is installed (FIG. 5B) on the mounting member 104, a corresponding pair of the locating protrusions 188,190 is structured to be disposed within the corresponding recess 206,208, respectively, of the enclosure 151 ' of the accessory module 200'. In this manner, the example accessory modules 200,200' (both shown in FIG. 6) are aligned and maintained in a predetermined position on the mounting member 104.

Figure 7:
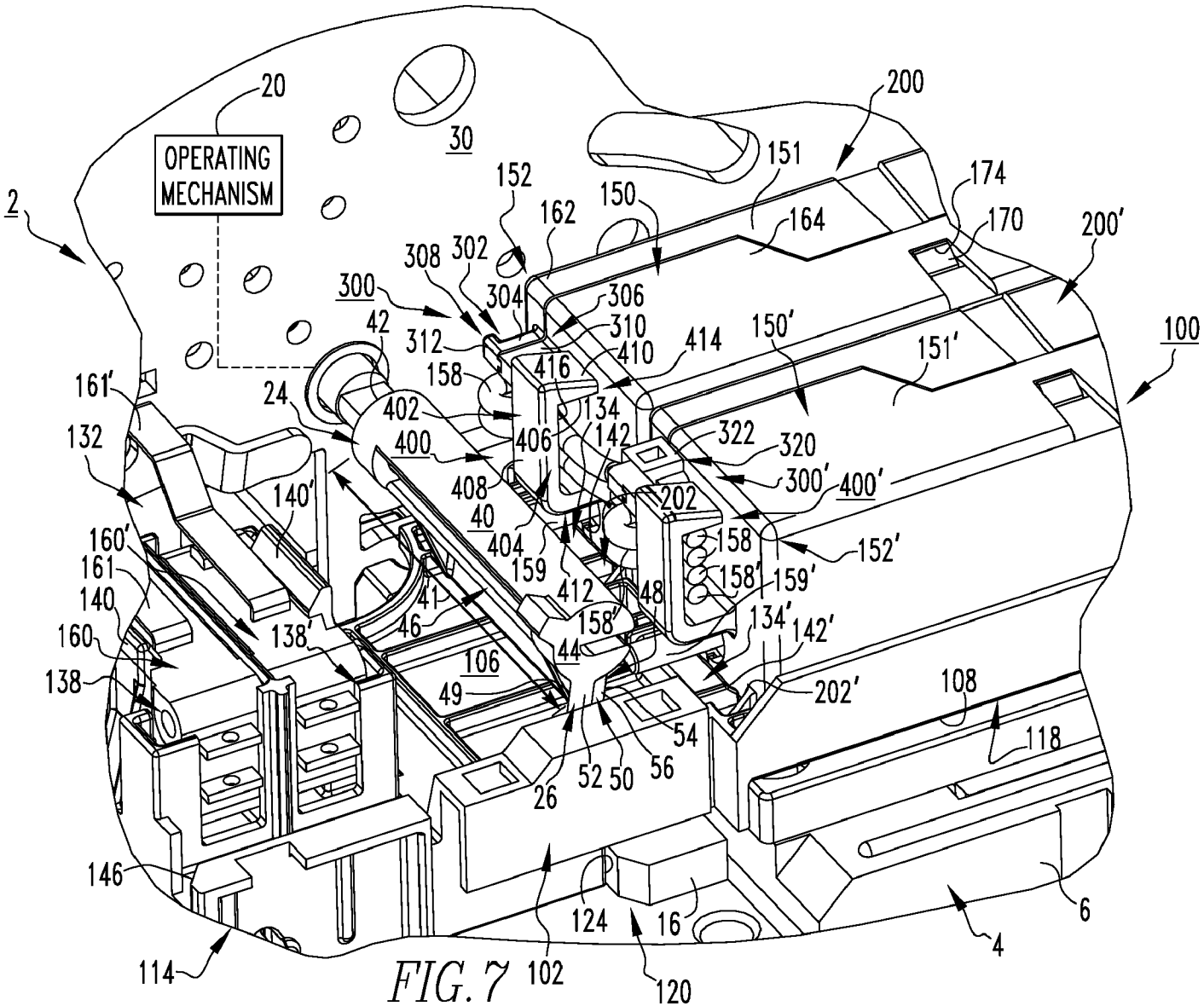
FIG. 7 is an isometric close-up view of a portion of the accessory tray, and accessory modules and electrical conductor mounts therefor of FIG. 6, also showing a portion of the circuit breaker, including the trip bar that the accessories actuate.

The example second mounting portion 132 for receiving the aforementioned secondary accessories 160,160' (FIGS. 2, 6 and 7) includes two molded compartments 138,138' (FIGS. 1, 2, 5A, 6 and 7) disposed between the first and second edges 110,112 of mounting member 104, at or about the first end 114 of the mounting member 104. Each molded compartment 138,138' includes a resilient protrusion 140,140', which extends outwardly from the mounting member 104 and is structured to bias against a corresponding one of the secondary accessories 160,160' when it is disposed within the molded compartment 138,138' as shown in FIGS. 2, 6 and 7. In this manner, the secondary accessories 160,160' are maintained in a predetermined position with respect to the mounting member 104 of the accessory tray 102. It will be appreciated that although two molded compartments 138,138', for receiving two corresponding secondary accessories 160,160', are shown and described herein, that any known or suitable alternative number and configuration of suitable mounting mechanisms (not shown) could be employed to secure any suitable number of secondary accessories (e.g., without limitation, the alarm mechanisms 160,160' shown in FIGS. 2, 6 and 7) on the mounting member 104, without departing from the scope of the invention. The example alarm mechanisms 160,160' (e.g., without limitation, bell alarms) each include a lever 161,161' (lever 161 is only partially shown in FIG. 7; see also FIGS. 2 and 6) which is structured to be moved in response to a trip condition of the circuit breaker 2; see also the arm shown in phantom line drawing in simplified form which is coupled to the trip bar 24 in FIG. 7).

The example mounting member is preferably a single-piece molded member 104, with the first and second mounting portions 130,132, guide mechanism 120, and first and second connection mechanisms 134,136 being molded segments of the single-piece molded member 104. Additionally, the first and second ends 114,116 of the mounting member 104 of the example accessory tray 102 further include first and second stops 146,148 disposed on the first and second ends 114,116, respectively, at or about the second edge 112 of the mounting member 104, as shown in FIGS. 1-4, 5A and 6. The stops 146,148 function to further properly orient the accessory tray 102 within (FIG. 3) the circuit breaker cavity 8. Specifically, when the accessory tray 102 is fully inserted within the cavity 8, as shown in FIG. 3, the first stop 146 is disposed at or about a first portion 17 of the circuit breaker housing 4, and the second stop 148 is disposed at or about a second portion 18 of the housing 4. The first and second portions are vertical members 17,18 of the example circuit breaker 2, which define the first and second ends 9,11, respectively, of the cavity 8 beneath the trip mechanism 22, as shown in FIGS. 1-3.

FIGS. 6, 7, 8A and 8B show a strain relief mechanism 300,300' (strain relief mechanism 300' is only shown in FIGS. 6 and 7) for the corresponding accessory module 200,200'. For economy of disclosure, only one strain relief mechanism 300 for the first accessory module 200 will be described in detail. It will, however, be appreciated that the strain relief mechanism 300' of the second accessory module 200' is substantially identical. Specifically, the first end 152 of the enclosure 151 of the accessory module 200 includes an aperture 156 (shown in hidden line drawing in FIG. 8A) and a number of electrical conductors 158 extending therethrough, and outwardly from the first end 152 of the enclosure 151. It will be appreciated that while the electrical conductors 158 which may comprise, for example and without limitation, electrical wires, extend outwardly with respect to the first end 152 of the enclosure 151, that such electrical conductors could be either input conductors (e.g., heading into the enclosure 151), or output conductors (e.g., leading out of the enclosure 151). In either case, it is desirable to secure the electrical conductors 158 in order to resist undesired movement thereof with respect to the enclosure 151 and the aperture 156 thereof. To accomplish this objective, the disclosed strain relief mechanism 300 includes a support 302, which is structured to extend outwardly from the first end 152 of the enclosure 151 and to be proximate the aperture 156 (shown in hidden line drawing in FIG. 8A) and electrical conductors 158 extending therethrough. A fastening mechanism 320 such as, for example and without limitation, the wire tie 322, which is shown, secures the electrical conductors 158 to the support 302.

Figure 8B:
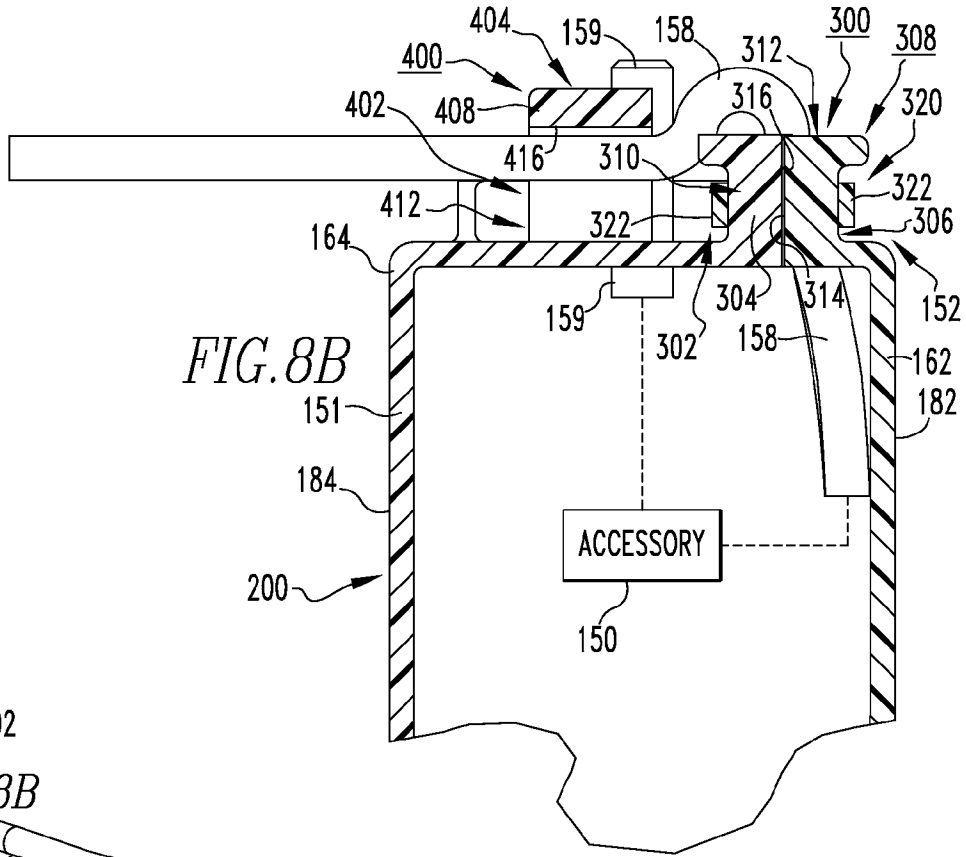
FIG. 8B is a sectional view taken along line 8B-8B of FIG. 8A with some internal components being shown in block form.
Figure 8A:
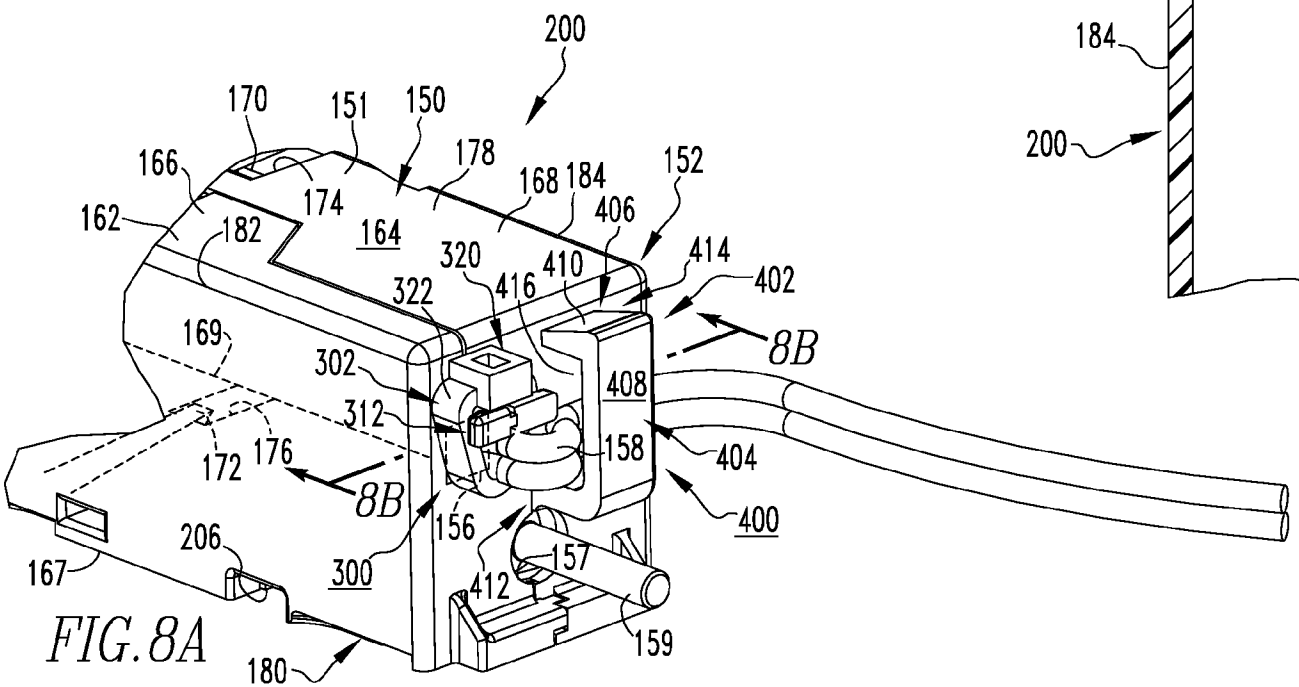
FIG. 8A is an isometric view of a portion of one of the accessory modules of FIG. 7, also showing a strain relief mechanism therefor.

More specifically, as shown in FIGS. 6, 7 and 8B, the example support 302 is a post 304 having a first end 306 disposed at or about the first end 152 of the enclosure 151, a second end 308 disposed opposite and distal from the first end 306, and a shank 310 extending between the first and second ends 306,308. The wire tie 322 (partially shown in section view in FIG. 8B) wraps around the electrical conductors 158 and the support 302, and is fastened in order to secure the electrical conductors 158 thereto, as best shown in FIGS. 8A and 8B. The second end 308 of the post 304 includes an enlarged head 312, which extends laterally outwardly from the post 304 in order to retain the wire tie 322 on the shank 310 of the post 304 (best shown in FIGS. 8A and 8B). It will be appreciated that any known or suitable alternative elongated fastening mechanism (not shown) other than the exemplary wire tie 322 could be employed to perform this securing function. It will also be appreciated that any combination of wire ties 322 or other suitable fastening mechanisms (not shown) could be employed to secure the electrical conductors 158,158' of the accessory modules 200,200' to the strain relief mechanisms 300,300' (both shown in FIGS. 6 and 7) thereof. For example, one wire tie 322 is shown for strain relief mechanism 300' in FIGS. 6 and 7.

The enclosure 151 of the example accessory module 200 includes a first portion 162 and a second portion 164, which is structured to be coupled to the first portion 162 in order to enclose the accessory 150 (shown in simplified form in FIG. 8B) therebetween, as shown in FIG. 8B. The post 304 of the example strain relief mechanism 300 further includes a first side 314 extending outwardly from the first portion 162, and a second side 316 extending outwardly from the second portion 164. Accordingly, the fastening mechanism 320 not only fastens the electrical conductors 158 to the post 304, but also fastens the first side 314 of the post 304 to the second side 316 of the post 304, thereby fastening the first and second portions 162,164 of the enclosure 151 of the accessory module 200. In the example shown and described herein, the first portion 162 of the enclosure 151 and the first side 314 of the post 304 are a first single-piece molded member, and the second portion 164 of the enclosure 151 and the second side 316 of the post 304 are a second single-piece molded member 164.

The first single-piece molded member 162 includes at least one molded protrusion 170,172 (first and second molded protrusions 170,172 are shown in FIG. 8A, with the second molded protrusion 172 being shown in hidden line drawing), and the second single-piece molded member 164 includes at least one receptacle 174,176 (two molded receptacles 174, 176 are shown in FIG. 8A, with the second receptacle being shown in hidden line drawing). Each receptacle 174,176 receives a corresponding one of the molded protrusions 170, 172 in order to fasten the first and second portions 162,164 of the enclosure 151 together, as shown in FIG. 8A, without requiring the use of a plurality of separate fasteners. The example first portion 162 includes a first side 166 and a second side 167, and the second portion 164 includes a first side 168 and a second side 169. The first resilient tab 170 extends outwardly from the first side 166 of the first portion 162 and is received by a corresponding first molded receptacle 174 on the first side 168 of the second portion 164. Similarly, the second resilient tab 172 extends outwardly from the second side 167 of the first portion 162 and is received by a corresponding second molded receptacle 176 on the second side 169 of the second portion 164, as shown in hidden line drawing in FIG. 8A. In this manner, the first and second portions 162,164 of the enclosure 151 of the accessory module 200 are secured together. It will be appreciated that the second accessory module 200' (FIGS. 2-4, 5A, 5B, 6 and 7) is secured together in substantially the same manner.

As shown in FIG. 8A, the enclosure 151 of the example accessory module 200 further includes a first side 178, a second side 180, and first and second opposing edges 182, 184. As best shown in FIG. 8A, the aperture 156 (shown in hidden line drawing) of the enclosure 151, the electrical conductors 158, and the strain relief mechanism 300 are disposed closer to the first side 178 of the enclosure 151 than the second side 180, and closer to the first edge 182 of the enclosure 151 than the second edge 184. It will, however, be appreciated that any suitable alternative configuration of these features (e.g., aperture 156; electrical conductors 158; strain relief mechanism 300) other than that which is shown and described herein, could be employed without departing from the scope of the invention. It will also be appreciated that the second accessory module 200' (FIGS. 2-4, 5A, 5B, 6 and 7) in the example accessory assembly 100, has a substantially identical structure as does the first accessory module 200, but is not numbered or discussed independently in its entirety, for economy of disclosure.

In addition to avoiding undesired strain on the electrical conductors 158, it is also desirable to position the electrical conductors 158 in a manner which will not undesirably interfere with the operation of the accessories (e.g., without limitation, primary accessories 150,150' and secondary accessories 160,160' of FIGS. 2, 6 and 7) or other components (e.g., without limitation, operating mechanism 20 (FIG. 9); trip bar 24 (FIG. 7)) of the circuit breaker 2 (FIGS. 1-4, 7, 9 and 10). To accomplish this objective, the example accessory module 200 further includes an electrical conductor mount 400,400', shown in FIGS. 2, 4 (showing electrical conductor mount 400'), 5A (showing electrical conductor mount 400'), 6, 7 (showing electrical conductor mounts 400,400') and 8A-8B (showing electrical conductor mount 400). For economy of disclosure, only one electrical conductor mount 400 for accessory module 200 will be discussed it will, however, be appreciated that the electrical conductor mount 400' for the second accessory module 200' (FIGS. 2-4, 5A, 5B, 6 and 7) is substantially identical to the electrical conductor mount 400 of first accessory module 200. Specifically, the accessory 150 further includes an actuator which, in the example shown and described herein is an actuator 159 (e.g., without limitation, a stem), that extends through a second aperture 157 of the first end 152 of the enclosure 151 of the accessory module 200, as best shown in FIGS. 6 and 8A. The electrical conductor mount 400 includes a mounting element 402, which is structured to be disposed on the enclosure 151 and to be proximate the electrical conductors 158 external to the enclosure 151. The mounting element 402 includes a receiving portion 404 structured to receive the electrical conductors 158, and a retaining portion 406 (not fully shown in FIG. 8B) structured to retain the electrical conductors 158 within the receiving portion 404. In this manner, the mounting element 402 mounts the electrical conductors 158 in a position (e.g., without limitation, above the accessory actuator 159), which may be predetermined, and in which the electrical conductors 158 do not obstruct operation of the actuator 159.

The example mounting element 402 is a resilient hook 408 having a first end 412 disposed on the enclosure 151, and a second end 414. It will be appreciated, however, that the mounting element 402 may comprise any known or suitable resilient element other than the example resilient hook 408, without departing from the scope of the invention. The retaining portion 406 (not fully shown in FIG. 8B) of the example resilient hook 408, is a hook or molded barb 410 (not shown in FIG. 8B) disposed at or about the second end 414 of the resilient hook 408. The receiving portion 404 extends outwardly from the enclosure 151 and turns and extends generally parallel with respect to the enclosure 151 in order to form an opening 416 between the mounting element 402 and the enclosure 151. The retaining portion 406 extends from the receiving portion 404 toward the enclosure 151. The resilient element 402 is deflectable among a first position corresponding to the retaining portion 406 being disposed at or about the enclosure 151, and a second position (not expressly shown) corresponding to the retaining portion 406 being deflectable away from the enclosure 151 in order to receive the electrical conductors 158 within opening 416 of the receiving portion 404. Accordingly, when the electrical conductors 158 are disposed within the receiving portion 404, the resilient element 402 biases the electrical conductors 158 toward the enclosure 151, as shown in FIG. 8A, in order to maintain them in the desired position. The example resilient hook 408 is a single-piece molded member 402.

Accordingly, it will be appreciated that the example accessory module 200 includes first and second apertures 156,157 (shown in hidden line drawing in FIG. 8A) disposed on the first end 152 of the enclosure 151. The electrical conductors 158 extend through the first aperture 156, and the actuator 159 (e.g., without limitation, stem) extends through the second aperture 157. Thus, in order to maintain the electrical conductors 158 in the position which does not interfere with the actuator 159, the example electrical conductor mount 400 is disposed above (with respect to FIGS. 6, 7 and 8A) the second aperture 157 and actuator 159 extending therethrough. More specifically, as previously discussed, the first aperture 156 (shown in hidden line drawing in FIG. 8A) is disposed closer to the first side 178 of the enclosure 151 of the accessory module 200 than the second side 180 thereof, and closer to the first edge 182 of the enclosure 151, than the second edge 184 thereof. The mounting element 402 extends outwardly from the first end 152 of the enclosure 151 beside the first aperture 156 (shown in hidden line drawing in FIG. 8A) and the electrical conductors 158 extending therethrough, and further extends above (with respect to FIGS. 6, 7 and 8A) the second aperture 157 and the actuator 159. The electrical conductors 158 thus extend generally laterally from the first aperture 156 (FIG. 8A) through the receiving portion 404 of the mounting element 402, and toward the second edge 184 of the enclosure 151, in order that electrical conductors 158 are maintained in a position which is above (with respect to FIGS. 6, 7 and 8A and spaced from the actuator 159. It will, therefore, be appreciated that the example second aperture 157 and actuator 159 are disposed closer to the second side 180 of the enclosure 151 than the first side 178 of the enclosure 151.

As shown in FIGS. 6 and 7, the example conductor mount 400 is structured to receive, for example and without limitation, two or four electrical conductors 158,158', and maintain them in the desired position. Specifically, when the accessory modules 200,200' of the first and second primary accessories 150,150' are disposed on the accessory tray 102 adjacent one another, as shown, the electrical conductor amount 400 of the first accessory module 200 secures the electrical conductors 158 of the first primary accessory 150, and the electrical conductor mount 400' of the second accessory module 200' secures both the electrical conductors 158 of the first primary accessory 150 and the electrical conductors 158' of the second primary accessory 150', as shown. Thus, it will be appreciated that the opening 416 of the receiving portion 406 of the resilient element 402 is capable of receiving, for example and without limitation, at least four electrical conductors 158,158' (e.g., electrical wires) and securing them in the desired position, which does not interfere with the operation of the actuators 159 and 159' of the accessory modules 200 and 200', respectively. As previously discussed, the example actuators 159,159' are stems. The stems 159,159' move inwardly and outwardly with respect to their corresponding enclosure 151, 151' to engage (FIG. 13B) a paddle 26 (FIG. 7) of the trip bar 24 (FIG. 7) of the circuit breaker 2, in order to, for example, move (e.g., pivot) the trip bar 24 and initiate a trip of the circuit breaker 2 in response to a trip condition.

Figure 10:
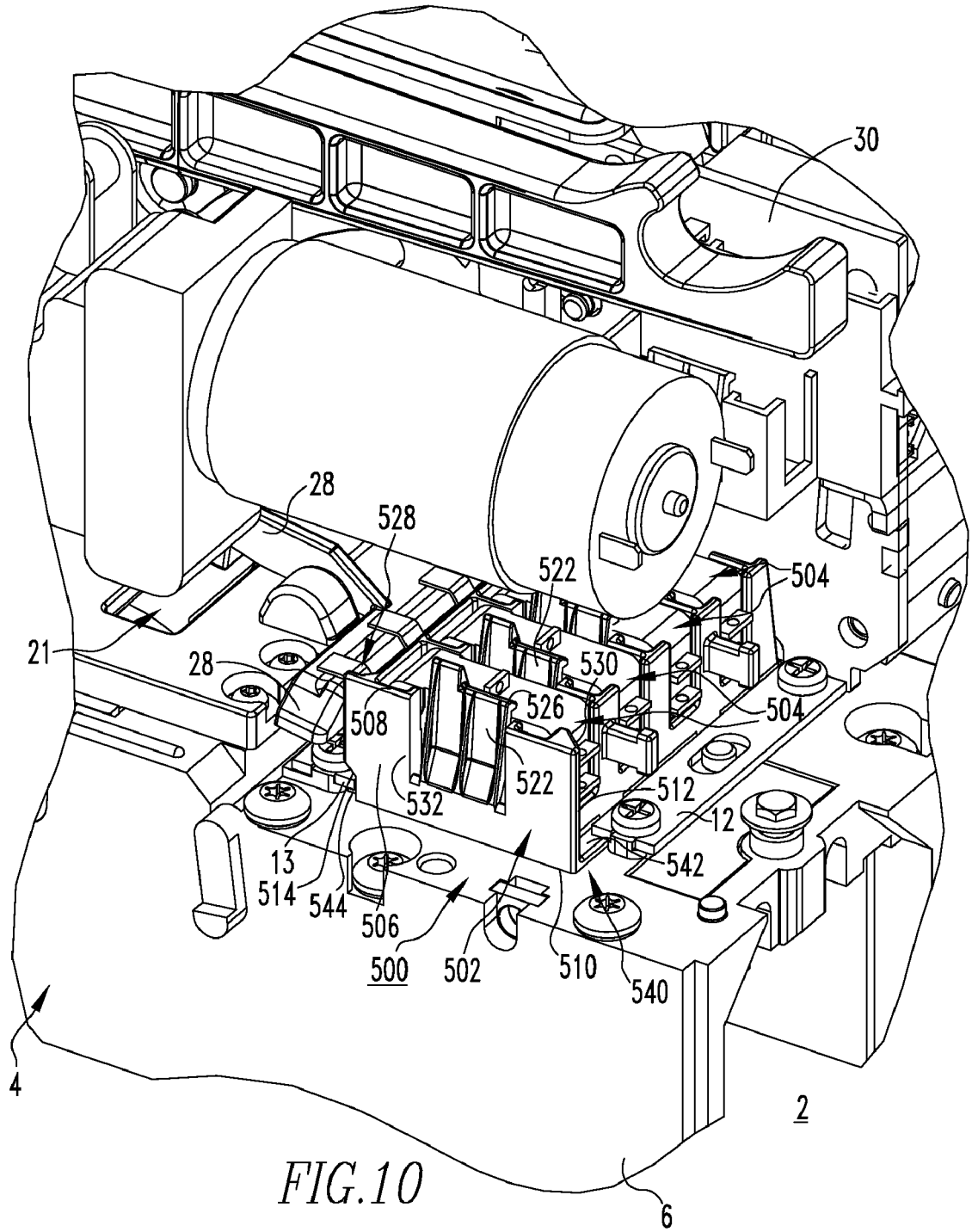
FIG. 10 is an assembled isometric view of the portion of the circuit breaker and auxiliary switch module therefor, of FIG. 9.
Figure 11:
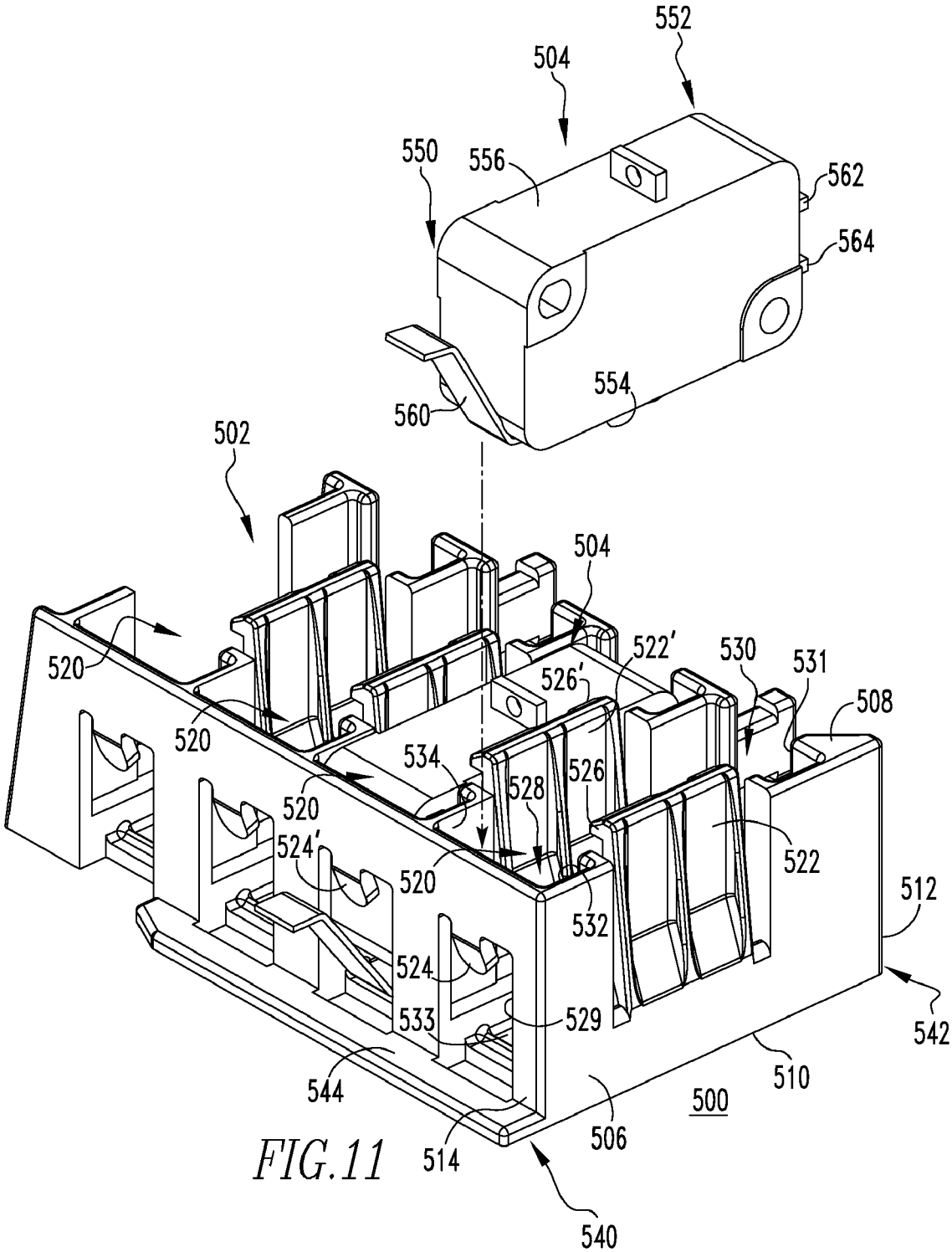
FIG. 11 is a partially exploded isometric view of the auxiliary switch module of FIG. 9, showing one micro-switch mounted on the module and another micro-switch just prior to being mounted on the module.
Figure 12A:
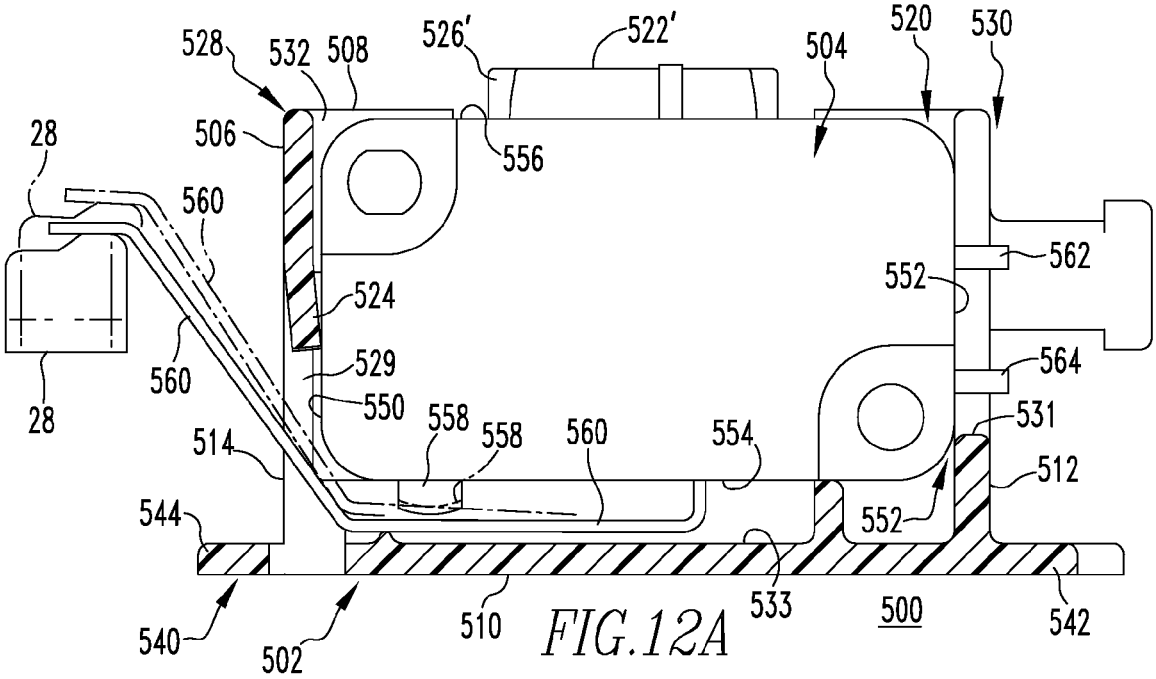
FIG. 12A is a sectional view taken along line 12A-12A of FIG. 9.
Figure 12B:
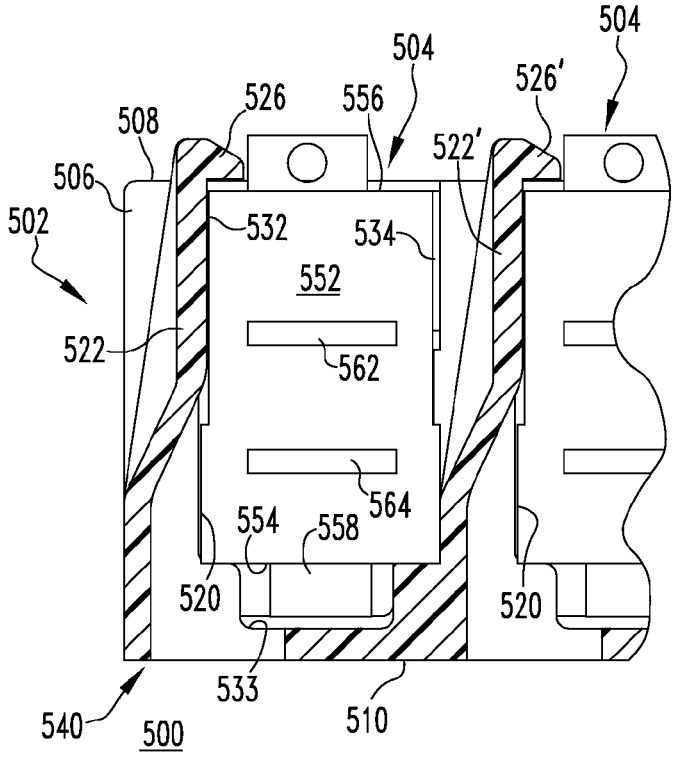
FIG. 12B is a sectional view taken along line 12B-12B of FIG. 9.

As shown in FIGS. 3, 9, 10, 11, 12A and 12B, the circuit breaker 2 further includes a sub-assembly 500 (shown in phantom line drawing in FIG. 3) having a plurality of auxiliary switches 504 (shown in phantom line drawing in FIG. 3; two auxiliary switches 504 are shown in FIGS. 11 and 12B; one auxiliary switch 504 is shown in FIG. 12A). The auxiliary switches 504 are cooperable with an actuating mechanism of the circuit breaker 2 (FIGS. 3, 9 and 10) which, in the example shown and described herein, is an auxiliary paddle 28 (FIGS. 3, 9, 10 and 12A). Specifically, the sub-assembly 500 includes an auxiliary switch tray 502 having a module 506 with first and second sides 508,510, and a plurality of mounts 520 disposed on the first side 508. Each mount 520 is structured to receive a corresponding one of the auxiliary switches 504. The auxiliary switch tray 502 also includes a base 540 disposed on the second side 510 of the module 506, and structured to be removably coupled to a mounting mechanism 12,13 (FIGS. 3, 9 and 10) of the circuit breaker 2 (FIGS. 3, 9 and 10). As will be discussed, the example mounting mechanism is a pair of opposing first and second guide rails 12,13 disposed on the circuit breaker housing 4 proximate the side plate 30 of the circuit breaker 2, as shown in FIGS. 3, 9 and 10. In this manner, the auxiliary switch tray 502 is structured to install the auxiliary switches 504 in a predetermined position with respect to the auxiliary paddle 28 of the circuit breaker 2, as shown in FIG. 10. In this manner, the auxiliary paddle 28 can activate the actuators (e.g., without limitation, levers 560) of the auxiliary switches 504, for example, in response to an opened or closed position of the separable contacts 10 (FIG. 9) of the circuit breaker 2. Specifically, the example auxiliary paddle 28 is cooperable with the pole shaft 21 (partially shown in FIGS. 9 and 10) of the circuit beaker operating mechanism 20 (FIG. 9) in order that the poleshaft moves (e.g., pivots) the auxiliary paddle 28 into engagement (shown in phantom line drawing in FIG. 10A) with the auxiliary switch actuators 560 when the poleshaft 21 rotates, for example, in response to the open or closed position. In this manner, the auxiliary switches can be employed to relay signals indicative of the status (e.g., opened, closed) of the circuit breaker 2, as desired.

As best shown in FIGS. 11, 12A and 12B, the example mounts 520 are molded compartments of the module 506. Each molded compartment 520 is structured to receive a corresponding one of the auxiliary switches 504, and to removably secure the auxiliary switch 504 to the module 506, without requiring the use of a number of separate fasteners. For economy of disclosure, only one molded compartment 520 will be discussed in detail. It will, however, be appreciated that the other molded compartments 520 of the module 506 of the auxiliary switch tray 502 are substantially identical. It will also be appreciated that although the example sub-assembly 500 and auxiliary switch tray 502 thereof shown and described herein include four molded compartments 520 for securing four corresponding auxiliary switches 504, that the module 506 of the auxiliary switch tray 502 could alternatively include any suitable number and configuration (not shown) of molded compartments 520 for securing any known or suitable accessory (e.g., without limitation, micro switches), without departing from the scope of the invention.

Each of the example molded compartments 520 includes a first resilient tab 522 (FIGS. 11 and 12B) and a second resilient tab 524 (not shown in FIG. 12B). The first resilient tab 522 (FIGS. 11 and 12B) includes a retaining portion 526 (FIGS. 11 and 12B) which is deflectable in order to receive the corresponding auxiliary switch 504 (see, for example, auxiliary switch 504 being installed in molded compartment 502 in FIG. 11). When the auxiliary switch 504 is disposed within the molded compartment 520, the retaining portion 526' (see also retaining portion 526 of FIG. 12B) retains the auxiliary switch 504 therein, and the second resilient tab 524 biases the auxiliary switch 504 into a desired orientation within the molded compartment 520, as shown in FIG. 12A. More specifically, the molded compartment 520 further includes a first end 528 (not shown in FIG. 12B), a second end 530 (not shown in FIG. 12B) disposed opposite and distal from the first end 528, a first side 532 (not shown in FIG. 12A) and a second side 534 (not shown in FIG. 12A) disposed opposite and spaced apart from the first side 532 of the molded compartment 520.

Each of the example auxiliary switches 504 includes a first end 550 (not shown in FIG. 12B), a second end 552 disposed opposite and distal from the first end 550, and first and second opposing sides 554,556. The aforementioned first resilient tab 522 is disposed on the first side 532 of the molded compartment 520. The example retaining portion 526 is a molded hook extending from at or about the first side 532 of the molded compartment 520 toward the second side 534 thereof. The example second resilient tab 524 extends from the first end 528 of the molded compartment 520 toward the second end 530, as shown in FIGS. 11 and 12A. Accordingly, when the auxiliary switch 504 is disposed in the molded compartment 520, the molded hook 526 of the first resilient tab 522 overlays the second side 556 of the auxiliary switch 504, as shown in FIG. 12B, and the second resilient tab 524 engages the first end 550 of the auxiliary switch 504 and biases the auxiliary switch 504 towards the second end 530 of the molded compartment 520, as shown in FIG. 12A, in order that the terminals 562,564 are disposed through access hole 531.

Continuing to refer to FIGS. 12A and 12B, the example auxiliary switch 504 further includes a switch 558 disposed on the first side 554 of the auxiliary switch 504, a lever 560 (FIG. 12A) extending from the first end 550 of the auxiliary switch 504 and being cooperable with the switch 558, and a number of terminals 562,564 (two are shown) (e.g., without limitation, common; normally open; normally closed) disposed on the second end 552 of the auxiliary switch 504. The first end 528 of the example molded compartment 520 includes an opening 529 structured to receive the lever 560, and the second end 530 of the molded compartment 520 includes an access hole 531 for providing access to the terminals 562,564 of the auxiliary switch 504 when it is properly disposed within the compartment 520, as shown in FIG. 12A. Additionally, the first side 532 of the molded compartment 520 includes a molded recess 533 for receiving the switch 558. In this manner, the auxiliary switch tray 502 provides an improved mechanism for precisely positioning and installing auxiliary switches 504 within the circuit breaker 2 (FIGS. 3, 9 and 10), wherein the auxiliary switches which, in the example shown and described herein are stock (e.g., unaltered; devoid of a separate mounting housing or custom bracket) micro-switches 504 and are removably mountable in a predetermined position, without requiring the use of a number of separate fasteners. In this manner, the auxiliary switches 504 and, in particular, the levers 560 thereof, can be actuatable by the circuit breaker auxiliary paddle 28 to depress the switch 558 of the auxiliary switch 504, as shown in phantom line drawing in FIG. 12A, in order to relay the desired signal regarding the operational state (e.g., without limitation, opened; closed) state of the circuit breaker 2 (FIGS. 3, 9 and 10) as previously discussed.

To further facilitate the accurate placement of the sub-assembly 500 within (FIGS. 3 (phantom line drawing) and 10) the circuit breaker 2 (FIGS. 3, 9 and 10), the example module 506 further includes first and second lateral protrusions 542,544 which respectively extend outwardly from the first and second edges 512,514 at or about the second side 510 of the module 506. Accordingly, when the module 506 is inserted into the circuit breaker 2, the first lateral protrusion 542 of the base 540 engages the first mounting rail 12 and the second lateral protrusion 544 of the base 540 of the module 506 engages the second mounting rail 13, in order to align the module 506 with respect to the circuit breaker 2, as shown in FIG. 9, and to install the auxiliary switches 504 in the predetermined position with respect to the auxiliary paddle 28 therein, as shown in FIGS. 3 (shown in phantom line drawing) and 10.

Accordingly, referring again to FIG. 11, it will be appreciated that the disclosed auxiliary switch tray 502 enables a plurality of micro-switches 504 (four example micro-switches 504 are shown) to be removably secured adjacent one another in the module 506 of the auxiliary switch tray 502, with the first resilient tabs 522,522' and retaining portions 526,526' thereof functioning to secure the micro-switches 504 within the corresponding molded compartments 520, and second resilient protrusions 524,524' functioning to bias the micro-switches 504 into the desired predetermined position within the corresponding compartment 520, as shown. In this manner, the levers 560 of the micro-switches 504 are relatively quickly and easily, precisely positioned with respect to the auxiliary paddle 28 of the circuit breaker operating mechanism 20 (shown in simplified form in FIG. 9), with all of the levers 560 of the micro-switches 504 being actuatable by the auxiliary paddle 28, as previously discussed. The disclosed sub-assembly 500 and auxiliary switch tray 502 therefor, thus greatly simplify the installation of accessories (e.g., without limitation, micro-switches 504), within the circuit breaker 2.

Figure 13A:
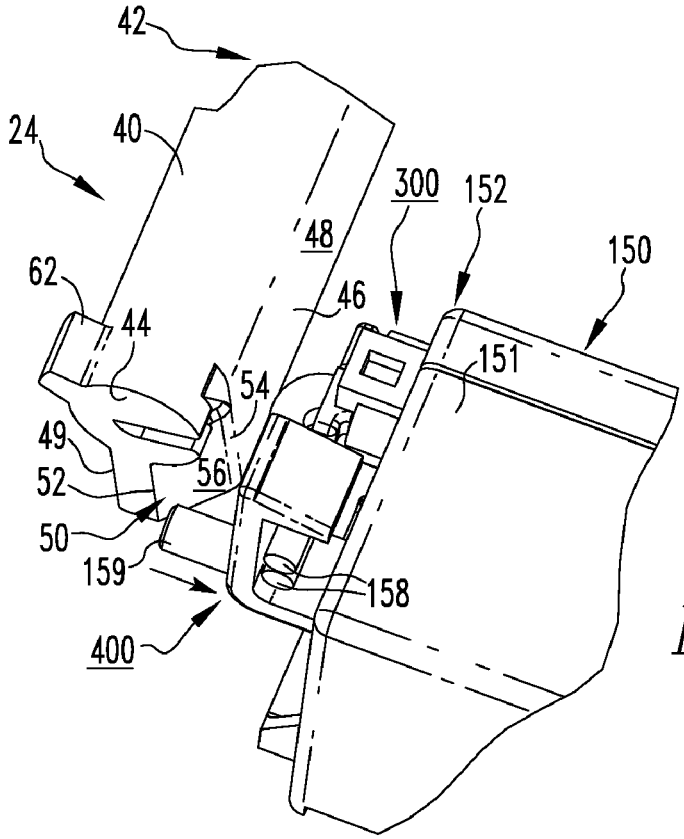
FIG. 13A is an isometric view of a portion of the trip bar and a portion of one accessory module of FIG. 7, showing the stem of the accessory module engaging a cam surface of the trip bar as the accessory module is being installed.
Figure 13B:
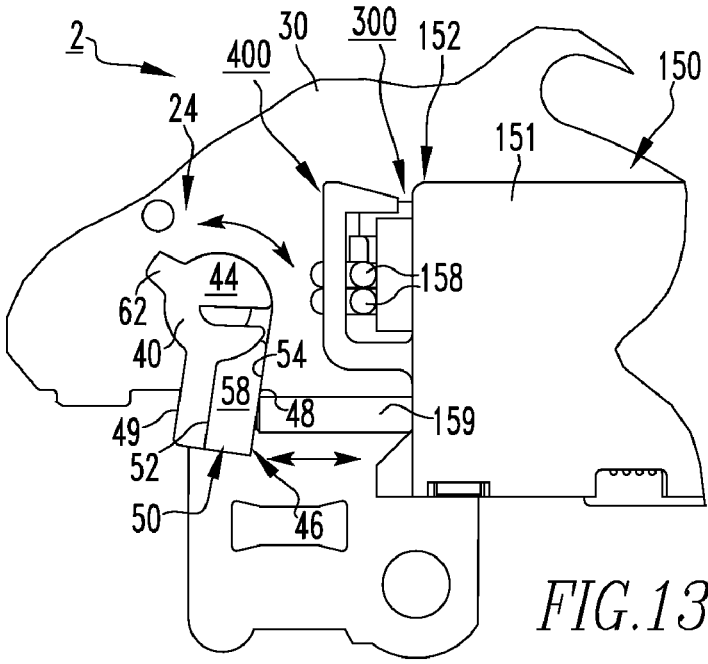
FIG. 13B is a side elevation view of the trip bar and portion of the accessory module of FIG. 13A modified to show the accessory module in the fully installed position with the stem engaging a paddle of the trip bar.

As shown in FIGS. 7, 13A and 13B, the trip bar 24 of the circuit breaker 2 (FIGS. 7 and 13B) includes an elongated pivot member 40 having a length 41 (FIG. 7), a first end 42, and a second end 44. The first end 42 is pivotably coupled to the circuit breaker operating mechanism 20 (shown in simplified form in phantom line drawing in FIG. 7). The second end 44 includes a deflecting mechanism 50, which is structured to deflect the actuator 159 (e.g., without limitation, stem) of the primary accessory 150, as shown in FIG. 13A, in order to facilitate insertion of the primary accessory 150 (see also primary accessory 150' of FIG. 7) into the circuit breaker housing 4 (FIG. 7). More specifically, the elongated pivot member 40 of the trip bar 24 includes at least one protrusion such as, for example and without limitation, a number of auxiliary paddles 46 (one auxiliary paddle 46 is shown), which extend outwardly from the elongated pivot member 40 between the first and second ends 42,44 (first end 42 is not shown in FIG. 13B) thereof. The auxiliary paddle 46 is structured to be actuated by the actuator 159 of the accessory 150 when the actuator 159 extends to position shown in FIG. 13B, for example, in response to a trip condition as determined by the primary accessories 150,150' (FIGS. 7 and 13B). At least one of the example primary accessories 150,150' (both shown in FIG. 7) is an under voltage release (UVR) device, and the example actuators 159,159' (both shown in FIG. 7) of the primary accessories 150,150' are stems 159,159'. Each stem 159,159' is movable between the first position of FIG. 7, in which the stem 159,159' is retracted (e.g., the UVR device is energized by a sufficient voltage) and does not actuate the auxiliary paddle 46 of the elongated pivot member 40, and the second (e.g., extended) position of FIG. 13B, in which the stem 159 actuates (e.g., moves) the auxiliary paddle 46, as previously discussed, and thereby pivots (e.g., clockwise with respect to FIG. 13B) the elongated pivot member 40 of the trip bar 24.

As shown in FIG. 13A, before the UVR device 150 is installed within the circuit breaker housing 4 (FIG. 7), the stem 159 is disposed in the second (e.g., extended) position, corresponding to the UVR device 150 being in a non-energized state, for example, before the aforementioned accessory assembly 100 (FIGS. 1-4, 5A, 5B, 6 and 7) and the accessories 150,150', 160,160' (all shown in FIGS. 6 and 7) thereof are installed within the circuit breaker housing 4 (FIG. 7). Then, as the UVR device 150 is being installed, the deflecting mechanism, which in the example shown and described herein is a cam surface 50, is increasingly deflected by the stem 159 of the UVR device 150 in order to pivot the trip bar 24 out of the way of the stem 159. It will, however, be appreciated that the stem 159 could alternatively be deflected by the cam surface 50 from the extended position toward the retracted position. In this manner, the UVR device 150 can be relatively easily and quickly inserted, for example, without requiring the stem 159 to be held in the retracted position (FIG. 7) by hand. Once the UVR device 150 is fully installed within the circuit breaker 2, as shown in FIG. 7, and is electrically connected and suitably energized, the UVR device 150 thereby holds the stem 159 in the retracted position until a trip condition (e.g., without limitation, under voltage) is detected thereby.

The example trip bar 24 is a single-piece molded member, which extends outwardly from the side plate 30 of the circuit breaker 2, as best shown in FIG. 7, and includes a single elongated auxiliary paddle 46. The example single elongated auxiliary paddle 46 extends from at or about the second end 44 of the elongated member 40 of the trip bar 24 toward the first end 42 thereof, and includes a first side 48, which is actuatable by the stem 159 of the UVR device 150, as previously discussed, and a second side 49 disposed opposite the first side 48. The example cam surface 50 includes a first end 52 disposed on the second end 44 of the elongated pivot member 40 of the trip bar 24, a second end 54 disposed on the first side 48 of the single elongated auxiliary paddle 46, and a tapered portion 56 that extends from the first end 52 toward the second end 54. It will, however, be appreciated that any known or suitable alternative deflecting mechanism (not shown) and/or number and configuration of auxiliary paddles (not shown) could be employed to suitably deflect and cooperate with the accessory stem 159, without departing from the scope of the invention.

As shown in FIG. 13B, the elongated pivot member 40 of the example trip bar 24 further includes a tab 62, which extends outwardly from the elongated pivot member 40. The example trip bar 24 and the single elongated auxiliary paddle 46 thereof, are biased (e.g., counterclockwise with respect to FIG. 1 3B) toward engagement with the stem 159 by a suitable bias element such as, for example and without limitation, a spring (not shown). In this manner, the trip bar 24 is continuously biased into a position in which it is ready to be actuated by the accessory stems 159,159', for example, in response to a trip condition of the circuit breaker 2.

Accordingly, the disclosed trip bar 24 facilitates insertion of primary accessories such as, for example and without limitation, UVR device (e.g., 150), which include an actuator 159 (e.g., without limitation, stem) that would otherwise interfere with the trip bar 24 during installation of the accessory 150 within the circuit breaker 2 (FIGS. 3 and 7). Thus, the primary accessories 150,150' can be relatively easily and quickly installed within the circuit breaker 2, without having to hold the actuators 159,159' of the accessories in their respective retracted positions. It will be appreciated that the primary accessories 150,150' can be installed with the stems 159,159' thereof being disposed in any suitable position. For example, both stems 159,159' could be extended. It will also be appreciated that the primary accessory 150 and/or primary accessory 150' could be, for example and without limitation, a shunt trip device or other suitable accessory that may be readily installed with a retracted stem (e.g., 159,159').

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An accessory tray for an electrical switching apparatus including a housing and a number of accessories, said housing having an exterior, a cavity, and at least one protrusion, said accessory tray comprising:

a mounting member comprising a first side structured to receive and removably secure said number of accessories of said electrical switching apparatus, and a second side disposed opposite the first side; and a guide mechanism structured to guide said mounting member into said cavity, wherein said mounting member is structured to be removable from said cavity in order to removably secure said number of accessories of said electrical switching apparatus thereon, wherein said mounting member is structured to be insertable into said cavity to install said number of accessories of said electrical switching apparatus in a predetermined position within said cavity, wherein said guide mechanism comprises a number of guides disposed at or about the second side of said mounting member; and wherein each of said number of guides is structured to engage a corresponding one of said at least one protrusion of said housing of said electrical switching apparatus in order to align said mounting member with said cavity, and wherein said mounting member further comprises a first edge and a second edge; wherein said at least one protrusion of said housing is a first protrusion and a second protrusion; wherein said number of guides is a first notch disposed on the second side of said mounting member and extending between the first edge and the second edge, and a second notch disposed on the second side of said mounting member and extending between the first edge and the second edge; and wherein, when said mounting member is inserted into said cavity, said first notch is structured to slidably engage said first protrusion and said second notch is structured to slidably engage said second protrusion.

2. An accessory tray for an electrical switching apparatus including a housing and a number of accessories, said housing having an exterior; a cavity, and at least one protrusion, said accessory tray comprising:

a mounting member comprising a first side structured to receive and removably secure said number of accessories of said electrical switching apparatus, and a second side disposed opposite the first side; and a guide mechanism structured to guide said mounting member into said cavity, wherein said mounting member is structured to be r movable from said cavity in order to removably secure said number of accessories of said electrical switching apparatus thereon, wherein said mounting member is structured to be insertable into said cavity to install said number of accessories of said electrical switching apparatus In a predetermined position within said cavity, wherein said mounting member further comprises a first end, a second end disposed opposite and distal from the first end, a generally planar intermediate, portion extending from at or about the second end toward the first end, and at least one mounting portion; wherein said at least one mounting portion comprises a first connection mechanism disposed on said generally planer intermediate portion and a second connection mechanism disposed proximate the second end; wherein said first connection mechanism is structured to receive and secure one end of a corresponding one of said number of accessories; and wherein said second connection mechanism is structured to releasablty secure the other and of said corresponding one of said number of accessories, and wherein said at least one mounting portion is a first mounting portion and a second mounting portion; wherein said first mounting portion extends longitudinally from the second end of said mounting member toward the first end of said mounting member; and wherein said second mounting portion is disposed at or about the first end of said mounting member and extends perpendicularly with respect to said first mounting portion.

3. The accessory tray of claim 2 wherein said second mounting portion comprises at least one molded compartment structured to receive another corresponding one of said number of accessories; wherein said at least one molded compartment comprises a resilient protrusion extending outwardly from said mounting member; and wherein said resilient protrusion is structured to bias against said another corresponding one of said number of accessories in order to maintain said another corresponding one of said number of accessories in a predetermined position with respect to said mounting member.

4. An accessory tray for an electrical switching apparatus including a housing and a number of accessories, said housing having an exterior, a cavity and at least one protrusion, sold accessory tray comprising:

a mounting member comprising a first side structured to receive and removably secure said number of accessories of said electrical switching apparatus, and a second side disposed opposite the first side; and a guide mechanism structured to guide said mounting member into said cavity wherein, said mounting member is structured to be removable from said cavity in order to removably secure said number of accessories of said electrical switching apparatus thereon, wherein said mounting member is structured to be insertable into said cavity to install said number of accessories of said electrical switching apparatus in a predetermined position within said cavity, wherein said mounting member further comprises a first end, a second end disposed opposite and distal from the first end, a generally planar intermediate portion extending from at or about the second end toward the first end, and at least one mounting portion; wherein said at least one mounting portion comprises a first connection mechanism disposed on said generally planer intermediate portion and a second connection mechanism disposed proximate the second end; wherein said first connection mechanism is structured to receive and secure one end of a corresponding one of said number of accessories; and wherein said second connection mechanism is structured to releasably secure the other end of said corresponding one of said number of accessories, and wherein said mounting member is a single-piece molded member; and wherein said at least one mounting portion, said guide mechanism, said first connection mechanism, and said second connection mechanism are molded segments of said single-piece member.

5. An electrical switching apparatus comprising:

a housing including an exterior and a cavity;

separable contacts enclosed by said housing;

an operating mechanism structured to open and close said separable contacts;

a number of accessories being cooperable with said operating mechanism; and an accessory tray comprising;

a mounting member comprising a first side and a second side disposed opposite the first side, said number of accessories being receivable on the first side of said mounting member, and a guide mechanism structured to guide said mounting member into said cavity, wherein said mounting member is removable from said cavity in order removably secure said number of accessories thereon, and wherein said mounting member is insertable into said cavity in order to install said number of accessories in a predetermined position within said cavity, wherein said housing of said electrical switching apparatus includes at least one protrusion; wherein said guide mechanism comprises a number of guides disposed at or about the second side of said mounting member; and wherein, when said mounting member is inserted into said cavity, each of said number of guides engaged a corresponding one of said at least one protrusion in order to align said mounting member with said cavity, and wherein said at least one protrusion of said housing of said electrical switching apparatus is a first guide rail and a second guide rail; wherein said mounting member further comprises a first edge and a second edge; wherein said number of guides is a first notch in the second side of said mounting member) said first notch extending between the first edge and the second edge, and a second notch in the second side of said mounting member, said second notch extending between the first edge and the second edge; and wherein, when said mounting member of said accessory tray is inserted into said cavity, said first notch slidably engages said first guide rail and said second notch slidably engages said second guide rail.

6. An electrical switching apparatus comprising:

a housing including an exterior and a cavity;

separable contacts enclosed by said housing;

an operating mechanism structured to open and close said separable contacts;

a number of accessories being cooperable with said operating mechanism; and an accessory tray comprising;

a mounting member comprising a first side and a second side disposed opposite the first side, said number of accessories being receivable on the first side of said mounting member, and a guide mechanism structured to guide said mounting member into said cavity, wherein said mounting member is removable from said cavity in order removably secure said number of accessories thereon, and wherein said mounting member is insertable into said cavity in order to install said number of accessories in a predetermined position within said cavity, and wherein said housing of said electrical switching apparatus includes a side plate having a number of openings; wherein said mounting member of said accessory tray further comprises a first edge and a second edge; wherein said guide mechanism comprises a number of lateral protrusions extending laterally outwardly from the first edge of said mounting member; and wherein, when said accessory tray is inserted into said cavity of said housing, each of said lateral protrusions engages a corresponding one or said number of openings of said side plate in order to align said mounting member of said accessory tray and thereby install said number of accessories in said predetermined position with said cavity of said housing.

7. An electrical switching apparatus comprising:

a housing including an exterior and a cavity;

separable contacts enclosed by said housing;

an operating mechanism structured to open and close said separate contacts;

a number of accessories being cooperable with said operating mechanism; and an accessory tray comprising;

a mounting member comprising a first side and a second side disposed opposite the first side, said number of accessories being receivable on the first side of said mounting member, and a guide mechanism structured to guide said mounting member into said cavity, wherein said mounting member is removable from said cavity in order removably secure said number of accessories thereon, and wherein said mounting member is insertable into said cavity in order to install said number of accessories in a predetermined position within said cavity, wherein said mounting member further comprises a first end, a second end disposed opposite and distal from the first end, a generally planar intermediate portion extending from at or about the second end toward the first end, and at least one mounting portion; wherein said at least one mounting portion comprises a first connection mechanism disposed on said generally planar intermediate portion and a second connection mechanism disposed proximate the second end; wherein each of said number of accessories has a first end and a second end; and wherein, when a corresponding one of said number of accessories is mounted on said mounting member, said first connection mechanism receives and secures the first end of a corresponding one of said number of accessories and said second connection mechanism releasable secures the second end of the corresponding one of said number of accessories, and wherein said number of accessories is a plurality of primary accessories and a number of secondary accessories; wherein said mounting member further comprises a first edge and a second edge; wherein said at least one mounting portion of said mounting member is a first mounting portion and a second mounting portion; wherein said first mounting portion extends longitudinally from the second end of said mounting member toward the first end of said mounting member; and wherein said second mounting portion is disposed at or about the first end of said mounting member and extends perpendicularly with respect to said first mounting portion.

8. The electrical switching apparatus of claim 7 wherein said electrical switching apparatus is a circuit breaker; wherein said primary accessories are two accessory modules selected from the group consisting of a shunt trip module and an undervoltage release module; wherein said two accessory modules are installed adjacent one another on said first mounting portion of said mounting member of said accessory tray; wherein said number of secondary accessories are at least one secondary accessory selected from the group consisting of an auxiliary switch and an alarm device; and wherein said at least one secondary accessory is installed on said second mounting portion of said mounting member of said accessory tray perpendicular with respect to said two accessory modules.

9. The electrical switching apparatus of claim 7 wherein said second mounting portion comprises a number of molded compartments; wherein each of said molded compartments comprises a resilient protrusion extending outwardly from said mounting member; wherein a corresponding secondary accessory of said number of secondary accessories is receivable within a corresponding one of said molded compartments; and wherein, when said corresponding secondary accessory is disposed within said corresponding one of said molded compartments, said resilient protrusion biases against said corresponding secondary accessory in order to maintain said corresponding secondary accessory in a predetermined position with respect to said mounting member.

10. An electrical switching apparatus comprising a housing including an exterior and a cavity;

separable contacts enclosed by said housing;

an operating mechanism structured to open and close said separable contacts;

a number of accessories being cooperable with said operating mechanism; and an accessory tray comprising;

a mounting member comprising a first side and a second side disposed opposite the first side, said number of accessories being receivable on the first side of said mounting member, and a guide mechanism structured to guide said mounting member into said cavity, wherein said mounting member is removable from said cavity in order removably secure said number of accessories thereon, and wherein said mount an member is insatiable into said cavity in order to install said number of accessories in a predetermined position within said cavity, and wherein said cavity includes a first end and a second end disposed opposite and distal from the first end of said cavity; wherein said mounting member further comprises a first end, a second end disposed opposite and distal from the first end of said mounting member, a first edge, and a second edge; and wherein, when said mounting member of said accessory tray is disposed within said cavity and said number of accessories are installed in said electrical switching apparatus, die first end of said mounting member is disposed adjacent the first end of said cavity and the second end of said mounting member is disposed adjacent the second end of said cavity.

11. The electrical switching apparatus of claim 10 wherein said housing of said electrical switching apparatus includes a first upright member disposed at or about the first end of said cavity and a second upright member disposed at or about the second end of said cavity; wherein the first end of said mounting member comprises a first stop disposed at or about the second edge; wherein the second end of said mounting member comprises a second stop disposed at or about the second edge; and wherein, when said mounting member of said accessory tray is filly inserted into said cavity and said number of accessories are installed in said electrical switching apparatus, said first stop is disposed at or about said first upright member and said second stop is disposed at or about said second upright member.

12. The electrical switching apparatus of claim 10 wherein said cavity of said electrical switching apparatus is disposed beneath said operating mechanism of said electrical switching apparatus; and wherein said accessory tray is receivable within said cavity in order to install said number of accessories in said predetermined position beneath said operating mechanism.

13. The electrical switching apparatus of claim 12 wherein said operating mechanism includes a trip mechanism structured to trip open said separable contacts in response to a trip condition; and wherein said accessory tray is receivable beneath said trip mechanism.

14. An accessory tray for an electrical switching apparatus including a housing, an operating mechanism, and a number of accessories, said housing having a cavity with a first end and the second and, said cavity being disposed beneath said operating mechanism, said accessory tray comprising:

an elongated member including a first end and second end disposed opposite and distal from the first end of said elongated member, said elongated member being structured to receive said number of accessories of said electrical switching apparatus; and a guide mechanism structured to guide said elongated member into and out of said cavity, in order to install said number of said accessories of said electrical switching apparatus beneath said operating mechanism, wherein, when said elongated member is disposed within said cavity, the first end of said elongated member is structured to be disposed at or about the first end of said cavity and the second end of said elongated member is structured to be disposed at or about the second end of said cavity.

15. The accessory tray of claim 14 wherein said number of accessories is a plurality of accessories.

16. The accessory tray of claim 14 wherein said guide mechanism is a plurality of guides structured to slidably guide said elongated member Into and out of a predetermined position within said cavity.

* * * * *